US011926941B2

(12) United States Patent
Inoue et al.

(10) Patent No.: US 11,926,941 B2
(45) Date of Patent: Mar. 12, 2024

(54) NET STRUCTURE MANUFACTURING APPARATUS AND NET STRUCTURE MANUFACTURING METHOD

(71) Applicant: TOYOBO CO., LTD., Osaka (JP)

(72) Inventors: Takuo Inoue, Tsuruga (JP); Takanori Nakamura, Tsuruga (JP); Hiroyuki Tsujii, Tsuruga (JP); Shinichi Kobuchi, Osaka (JP)

(73) Assignee: TOYOBO CO., LTD., Osaka (JP)

( * ) Notice: Subject to any disclaimer, the term of this patent is extended or adjusted under 35 U.S.C. 154(b) by 837 days.

(21) Appl. No.: 16/981,838

(22) PCT Filed: Mar. 7, 2019

(86) PCT No.: PCT/JP2019/009102

§ 371 (c)(1),
(2) Date: Sep. 17, 2020

(87) PCT Pub. No.: WO2019/188090

PCT Pub. Date: Oct. 3, 2019

(65) Prior Publication Data

US 2021/0115607 A1 Apr. 22, 2021

(30) Foreign Application Priority Data

Mar. 28, 2018 (JP) ..... 2018-063111
Mar. 28, 2018 (JP) ..... 2018-063112
Mar. 28, 2018 (JP) ..... 2018-063113

(51) Int. Cl.
*D04H 3/16* (2006.01)

(52) U.S. Cl.
CPC ..... *D04H 3/16* (2013.01)

(58) Field of Classification Search
CPC ..... D04H 3/16; D04H 3/045; D01D 5/088; D01D 5/0885
See application file for complete search history.

(56) References Cited

U.S. PATENT DOCUMENTS

2006/0116045 A1 6/2006 Nishibori et al.
2016/0023387 A1* 1/2016 Takaoka ..... B29C 48/355 264/178 F (Continued)

FOREIGN PATENT DOCUMENTS

CN 116056594 A * 5/2023 ..... D01D 5/0985
EP 1586687 A1 10/2005

(Continued)

OTHER PUBLICATIONS

Office Action dated Jul. 27, 2022, issued in counterpart CN application No. 201980022277.5, with English translation. (7 pages).

(Continued)

*Primary Examiner* — Tajash D Patel
(74) *Attorney, Agent, or Firm* — WHDA, LLP

(57) ABSTRACT

A net structure manufacturing apparatus (1) comprising: a nozzle (10) having a discharge hole (11) from which melted thermoplastic resin is extruded so as to be formed as a filament; a water tank (20) disposed below the nozzle (10); a conveying device (30) provided to the water tank (20) and configured to convey a net structure (60) having a resin as the filament (12); and a gas ejection device (40) provided to the water tank (20) and configured to eject gas.

12 Claims, 6 Drawing Sheets

(56) References Cited

U.S. PATENT DOCUMENTS

| | | | | |
|---|---|---|---|---|
| 2016/0281265 | A1* | 9/2016 | Bueno | D01D 5/088 |
| 2019/0376208 | A1* | 12/2019 | Cinquemani | B29C 48/87 |
| 2023/0042125 | A1* | 2/2023 | Li | D01D 10/06 |

FOREIGN PATENT DOCUMENTS

| | | | |
|---|---|---|---|
| JP | 58-81664 | A | 5/1983 |
| JP | S61-97457 | A | 5/1986 |
| JP | H05-106153 | A | 4/1993 |
| JP | 7-138864 | A | 5/1995 |
| JP | 2015-155588 | A | 8/2015 |
| JP | 2017-110310 | A | 6/2017 |
| JP | 2018-28161 | A | 2/2018 |

OTHER PUBLICATIONS

Office Action dated Sep. 29, 2022, issued in counterpart EP application No. 19774345.3. (6 pages).
Office Action dated Nov. 9, 2021, issued in counterpart JP Application No. 2018-063112, with machine translation. (8 pages).
Office Action dated Nov. 9, 2021, issued in counterpart JP Application No. 2018-063113, with machine translation. (6 pages).
Extended (Supplementary) European Search Report dated Dec. 1, 2021, issued in counterpart EP Application No. 19774345.3. (8 pages).
International Search Report dated Apr. 23, 2019, issued in counterpart application No. PCT/JP2019/009102, w/English translation (4 pages).
Office Action dated Mar. 1, 2022, issued in counterpart TW Application No. 108110184, with English Translation. (13 pages).
Office Action dated Mar. 14, 2022, issued in counterpart IN Application No. 202047045846, with English Translation. (7 pages).
Written Opinion dated Apr. 23, 2019, issued in counterpart application No. PCT/JP2019/009102, with English translation. (9 pages).
International Search Report dated Apr. 23, 2019, issued in counterpart application No. PCT/JP2019/009102, with English translation. (5 pages).
Office Action dated Jan. 7, 2022, issued in counterpart CN Application No. 201980022277.5, with English machine translation (18 pages).
Office Action dated Feb. 20, 2023, issued in counterpart TW Application No. 108110184, with English Translation. (11 pages).
Office Action dated Mar. 9, 2023, issued in counterpart EP Application No. 19774345.3. (5 pages).
Office Action dated Oct. 7, 2022, issued in counterpart TW application No. 108110184, with English translation. (9 pages).

* cited by examiner

[FIG. 1]
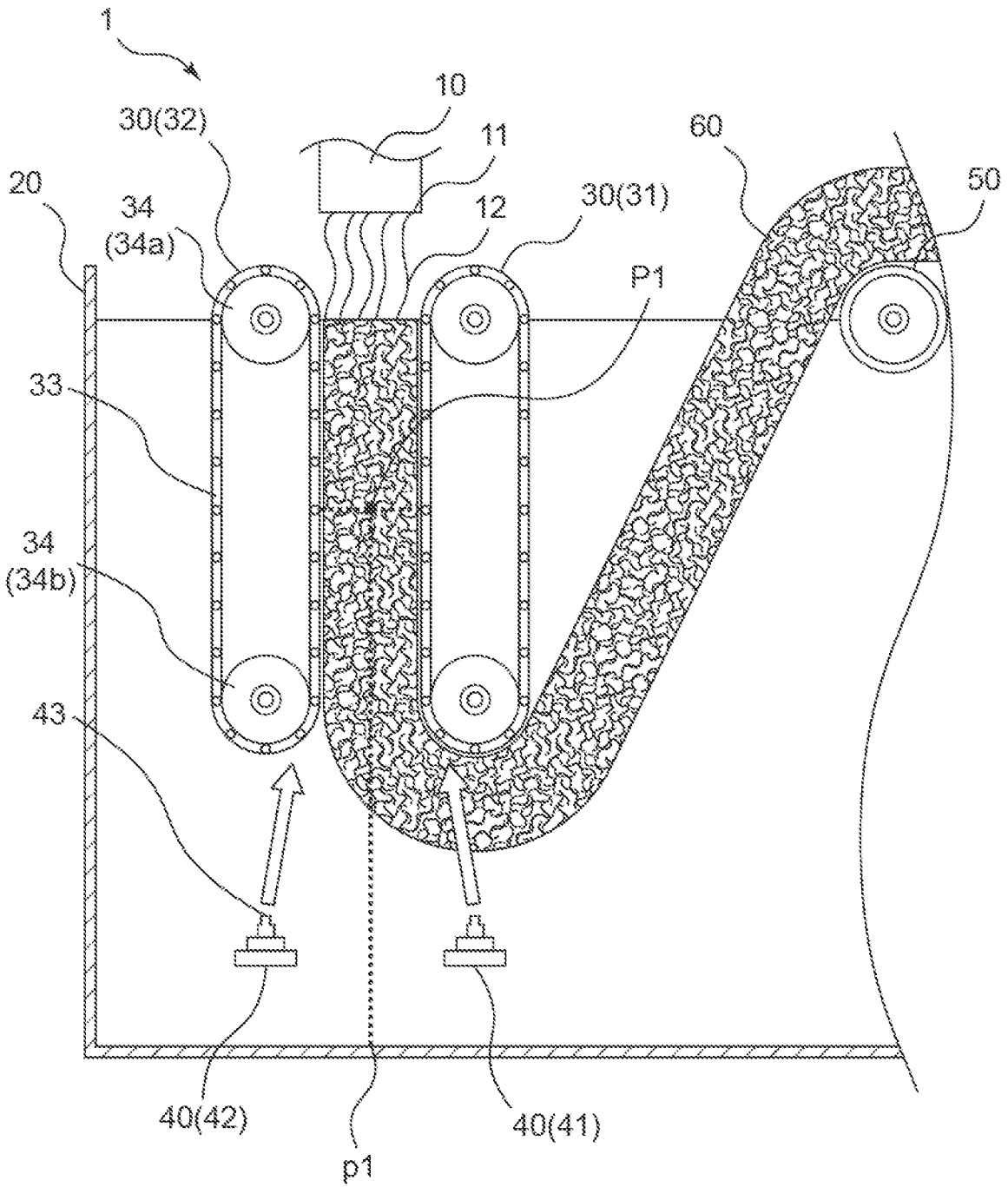

[FIG. 2]
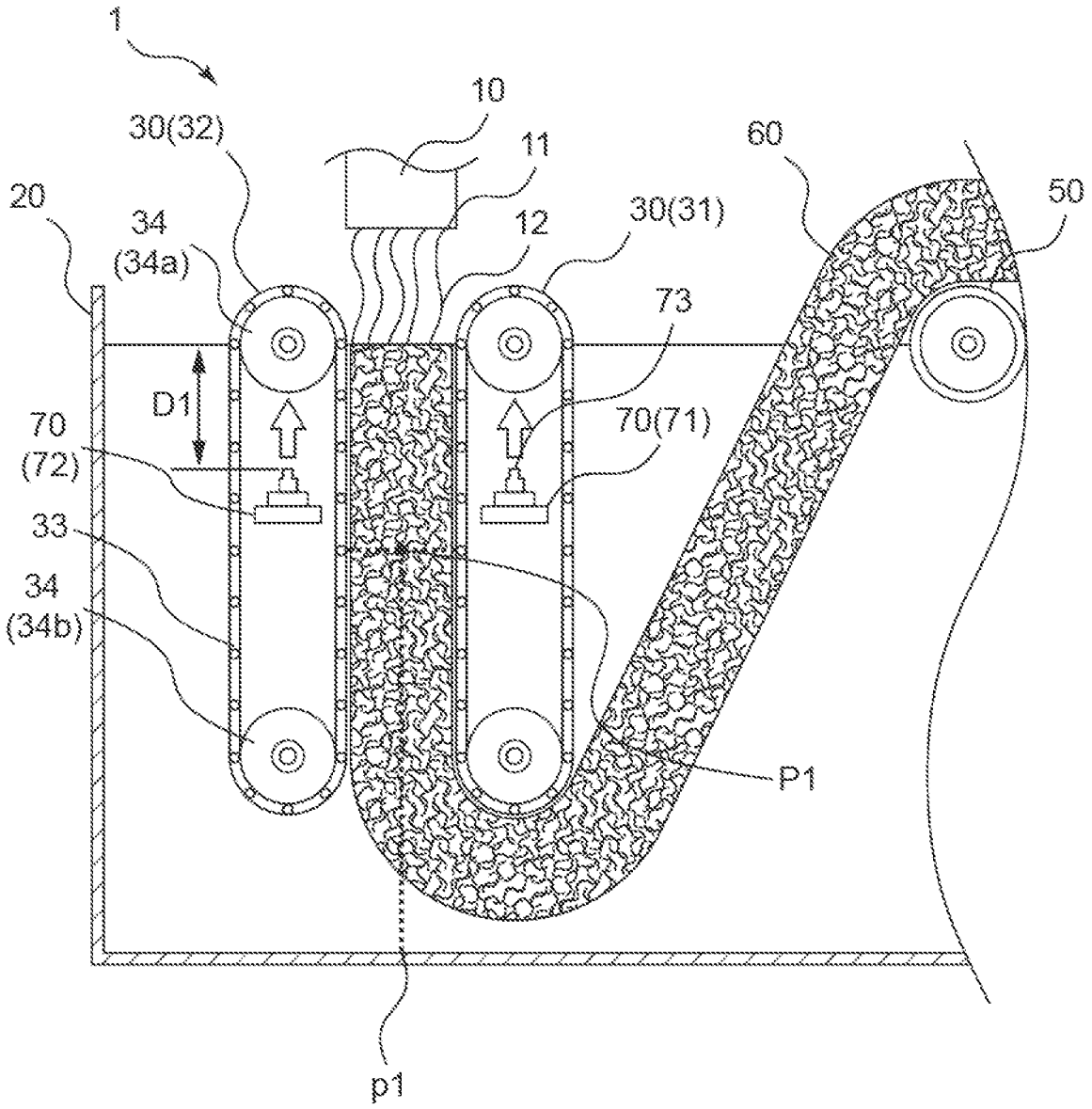

[FIG. 3]
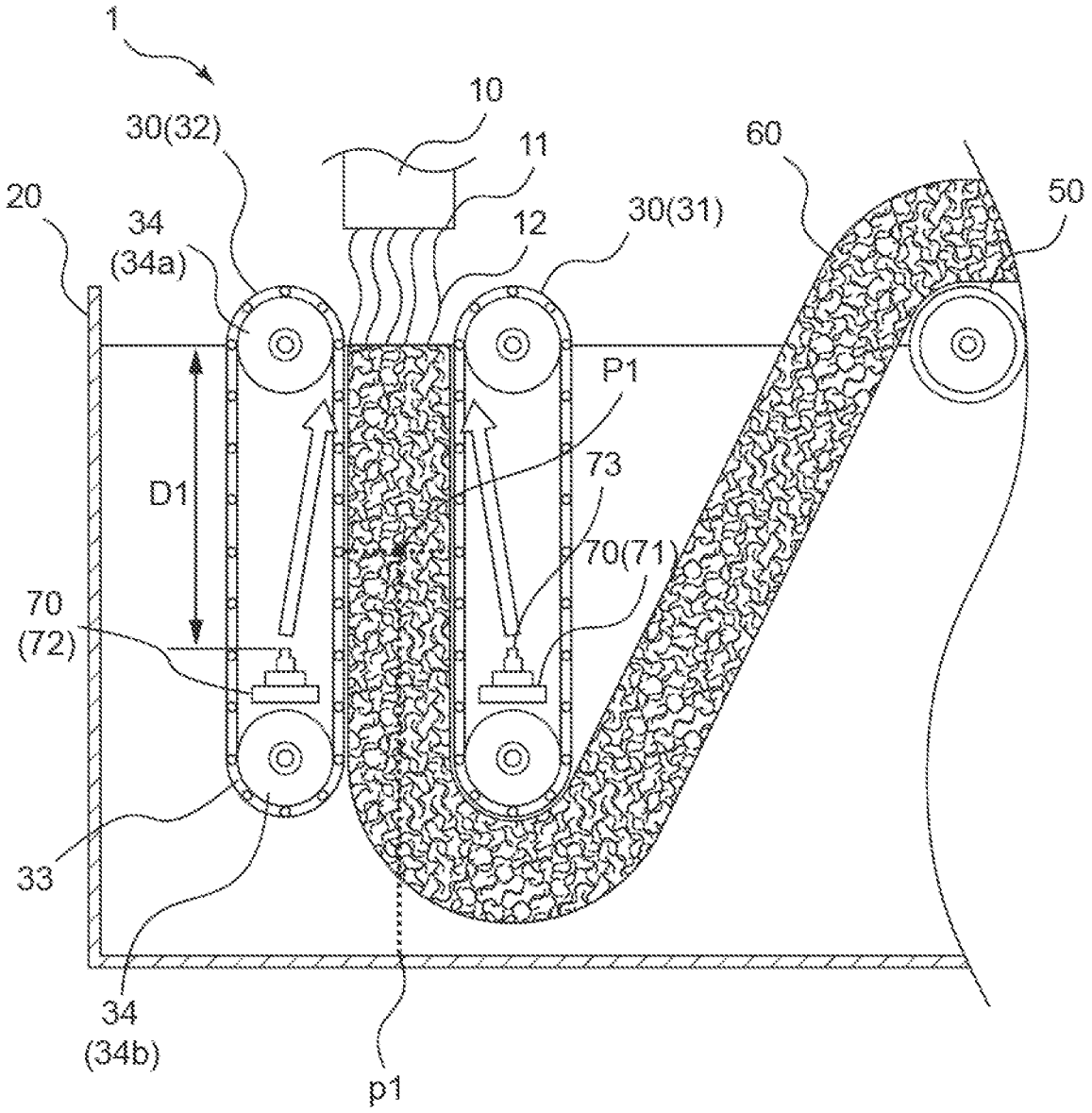

[FIG. 4]
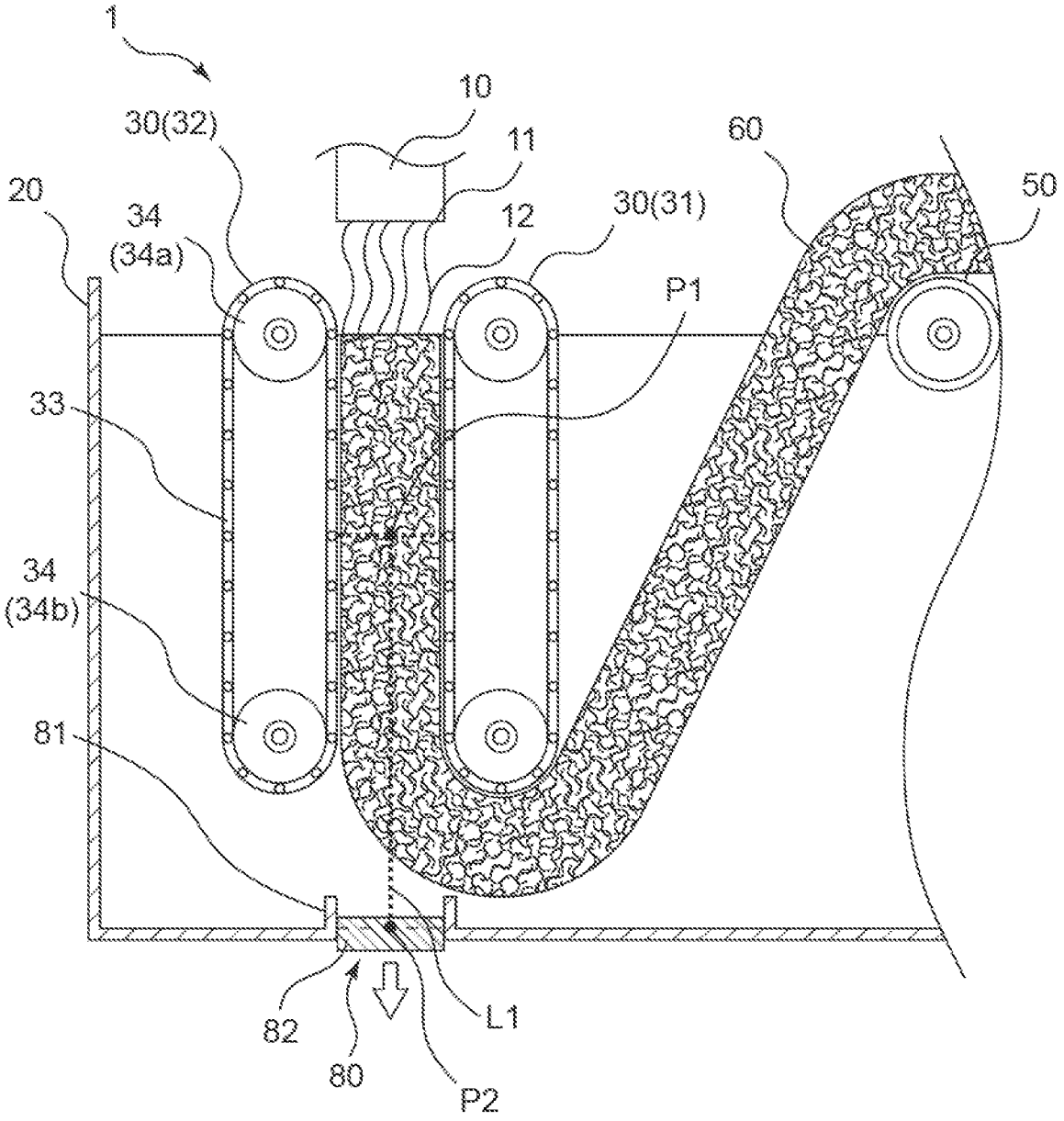

[FIG. 5]
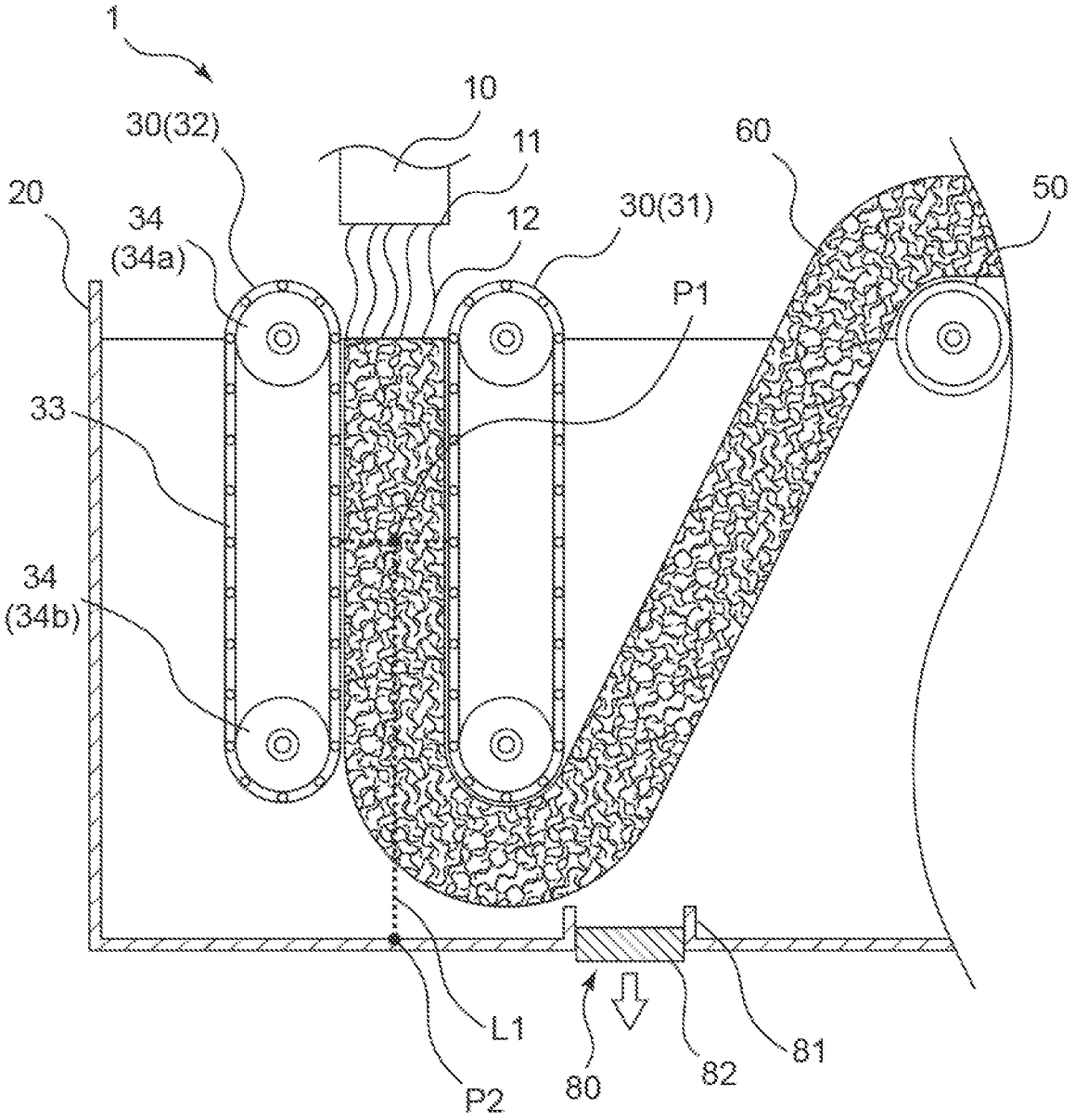

[FIG. 6]
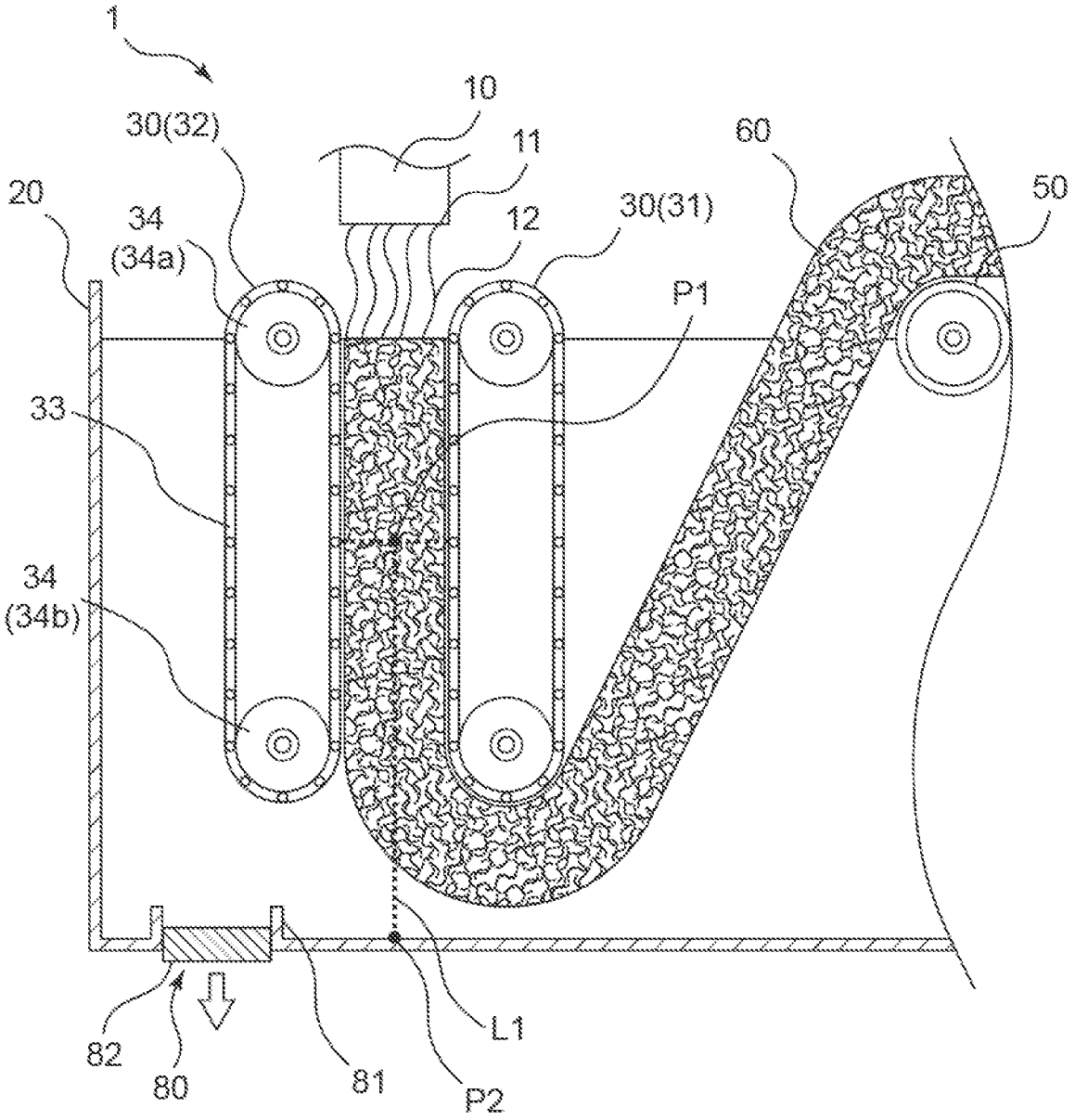

NET STRUCTURE MANUFACTURING APPARATUS AND NET STRUCTURE MANUFACTURING METHOD

TECHNICAL FIELD

The present invention relates to a net structure manufacturing apparatus and a net structure manufacturing method.

BACKGROUND ART

At present, net structures have been widely used as cushion materials used for furniture, beddings such as beds, and seats for vehicles such as electric trains, automobiles, and two-wheeled vehicles. A net structure has advantages of having the same level of durability as that of a foamed-crosslinking type urethane, and having more excellent moisture permeability, water permeability, and air permeability, and lower heat storage capacity than the foamed-crosslinking type urethane so that the net structure is less likely to become stuffy. Furthermore, since a net structure is made of a thermoplastic resin, the net structure also has an advantage of being easily recycled so that there is no anxiety about residual chemicals, whereby the net structure is environmentally friendly.

As a net structure manufacturing apparatus, there has been a three-dimensional net structure manufacturing apparatus including: a die having a plurality of extrusion holes from which melted thermoplastic resin is extruded downward as filaments to be lowered; a water tank for cooling an aggregate of the filaments; a pair of conveyors which are disposed below the extrusion holes so as to oppose each other and around which endless members having gaps therein are provided; and forced convection members disposed in internal regions of the conveyors and including at least either ejection holes for ejecting cooling water toward the aggregate through the gaps or suction holes for suctioning water through the gaps from near the aggregate. The aggregate is taken in by the conveyors at a speed lower than the speed of lowering the filaments and is cooled in the water tank, thereby forming the aggregate as a three-dimensional net structure (see, for example, Patent Literature 1).

In addition, as a net structure manufacturing method, there has been a three-dimensional net structure manufacturing method including: an extruding step of extruding melted thermoplastic resin as a plurality of filaments downward to lower the filaments; a loop forming step of causing the filaments to come into contact with a water surface or come into contact with a pair of guide members opposing each other with an aggregate of the lowered filaments therebetween or conveyors opposing each other below the guide members, so that the filaments are irregularly intertwined with one another and intertwined portions thereof are thermally adhered; a take-in step of causing the aggregate to be held between the conveyors and taken into water at a speed lower than the speed of lowering the filaments; and a cooling step of, with gaps being present in endless members provided around the conveyors, ejecting cooling water from internal regions of the conveyors through the gaps toward a take-in region between the pair of conveyors, or suctioning water from the take-in region through the gaps to the internal regions of the conveyors, thereby causing forced convection of water and cooling the aggregate in the water concurrently with the take-in step (see, for example, Patent Literature 1).

PRIOR ART DOCUMENTS

Patent Documents

Patent Document 1: JP-A-2015-155588

SUMMARY OF THE INVENTION

Problems to be Solved by the Invention

However, in the net structure manufacturing apparatus and manufacturing method as in Patent Literature 1, cooling water is ejected toward a net structure during manufacturing of the net structure, and a difference in the degree of cooling is generated between a surface portion, of the net structure, with which cooling water is brought into direct contact and the inside, of the net structure, with which the cooling water is not brought into contact, whereby unevenness in cooling occurs in the thickness direction of the net structure. If unevenness in cooling occurs during manufacturing of the net structure, problems arise in that, on the inside having been insufficiently cooled, the repeated compression residual strain becomes high, and the hardness retention rate after repeated compression becomes low, whereby the net structure becomes significantly inferior in durability.

The present invention has been made to solve the above-described problems of the conventional technologies, and an object of the present invention is to provide a manufacturing apparatus and a manufacturing method for a net structure in which, when the net structure is cooled during manufacturing of the net structure, unevenness in cooling is less likely to occur in the thickness direction of the net structure and which has sufficient durability.

Solutions to the Problems

A first net structure manufacturing apparatus of the present invention that has solved the above problems comprising: a nozzle having a discharge hole from which melted thermoplastic resin is extruded so as to be formed as a filament; a water tank disposed below the nozzle; a conveying device provided to the water tank and configured to convey a net structure having a resin as the filament; and a gas ejection device provided to the water tank and configured to eject gas.

The first net structure manufacturing apparatus is preferable wherein the gas ejection device is disposed below the conveying device.

The first net structure manufacturing apparatus is preferable wherein the gas ejection device has an ejection hole from which gas is ejected, and a direction of a normal to the ejection hole extends toward a water surface in the water tank.

The first net structure manufacturing apparatus is preferable wherein the conveying device is composed of at least a first conveyor and a second conveyor, the net structure is located between the first conveyor and the second conveyor, the gas ejection device has an ejection hole from which gas is ejected, and a direction of a normal to the ejection hole extends toward the net structure located between the conveyors.

The first net structure manufacturing apparatus is preferable wherein an amount of gas to be ejected by the gas ejection device increases in accordance with increase in an amount of the resin extruded from the nozzle.

The first net structure manufacturing apparatus is preferable wherein an amount of gas to be ejected by the gas ejection device increases in accordance with increase in a speed of the conveying device.

The first net structure manufacturing apparatus is preferable wherein the conveying device includes a mesh-pattern belt and a drive roller.

The first net structure manufacturing apparatus is preferable further comprising a net structure drawing device provided on one side of the water tank and configured to draw the net structure, wherein the conveying device is composed of at least a first conveyor and a second conveyor, and the gas ejection device is located on the net structure drawing device side relative to a vertical plane that includes a midpoint between the first conveyor and the second conveyor.

The first net structure manufacturing apparatus is preferable wherein the gas ejection device is composed of at least a first gas ejector and a second gas ejector, the conveying device is composed of at least a first conveyor and a second conveyor, the first gas ejector is disposed vertically below the first conveyor, and the second gas ejector is disposed vertically below the second conveyor.

A method for manufacturing a first net structure manufacturing apparatus of the present invention that has solved the above problems comprising the steps of causing melted thermoplastic resin to be extruded so as to be formed as a filament; conveying, in a water tank, a net structure having a resin as the filament by conveyance means; and ejecting gas into water in the water tank by a gas ejection device.

A second net structure manufacturing apparatus of the present invention that has solved the above problems comprising: a nozzle having a discharge hole from which melted thermoplastic resin is extruded so as to be formed as a filament; a water tank disposed below the nozzle; a conveying device provided to the water tank and configured to convey a net structure having a resin as the filament; and a water ejection device provided to the water tank and configured to eject water in a predetermined direction, wherein the conveying device is composed of at least a first conveyor and a second conveyor, the net structure is located between the first conveyor and the second conveyor, and the net structure located between the conveyors is not present on an extension line of an ejection direction of water from the water ejection device.

The second net structure manufacturing apparatus is preferable wherein the ejection direction of water from the water ejection device extends toward a water surface in the water tank.

The second net structure manufacturing apparatus is preferable wherein the ejection direction of water from the water ejection device extends, relative to a vertical direction, toward the net structure located between the conveyors.

The second net structure manufacturing apparatus is preferable wherein the water ejection device has an ejection hole from which water is ejected, and the ejection hole is located below a water surface in the water tank by not less than 0.1 mm and not greater than 400 mm.

The second net structure manufacturing apparatus is preferable wherein the water ejection device is disposed inside the conveying device.

The second net structure manufacturing apparatus is preferable wherein the conveying device includes a mesh-pattern belt and a drive roller.

The second net structure manufacturing apparatus is preferable wherein the drive roller is composed of at least an upper drive roller and a lower drive roller, the upper drive roller is disposed at an upper portion of an inside of the conveying device, and the lower drive roller is disposed at a lower portion of the inside of the conveying device, and a direction of water to be ejected by the water ejection device extends toward the upper drive roller.

The second net structure manufacturing apparatus is preferable wherein an amount of water to be ejected by the water ejection device increases in accordance with increase in an amount of the resin extruded from the nozzle.

The second net structure manufacturing apparatus is preferable wherein an amount of water to be ejected by the water ejection device increases in accordance with increase in a speed of the conveying device.

The second net structure manufacturing apparatus is preferable wherein a direction of water to be ejected by the water ejection device is associated with an amount of the resin extruded from the nozzle.

The second net structure manufacturing apparatus is preferable wherein a direction of water to be ejected by the water ejection device is associated with a speed of the conveying device.

The second net structure manufacturing apparatus is preferable wherein the water ejection device has an ejection hole from which water is ejected, and a position of the ejection hole from a water surface in the water tank is associated with an amount of the resin extruded from the nozzle.

The second net structure manufacturing apparatus is preferable wherein the water ejection device has an ejection hole from which water is ejected, and a position of the ejection hole from a water surface in the water tank is associated with a speed of the conveying device.

A method for manufacturing a second net structure manufacturing apparatus of the present invention that has solved the above problems comprising the steps of causing melted thermoplastic resin to be extruded so as to be formed as a filament; conveying, in a water tank, a net structure having a resin as the filament by a first conveyor and a second conveyor; and ejecting, by a water ejection device, water in a direction that does not extend toward the net structure located between the first conveyor and the second conveyor.

A third net structure manufacturing apparatus of the present invention that has solved the above problems comprising: a nozzle having a discharge hole from which melted thermoplastic resin is extruded so as to be formed as a filament; a water tank disposed below the nozzle; a conveying device provided to the water tank and configured to convey a net structure having a resin as the filament; and a water discharge port provided in a bottom portion of the water tank.

The third net structure manufacturing apparatus is preferable wherein, in the water tank, a barrier board is provided on a periphery of the water discharge port.

The third net structure manufacturing apparatus is preferable further comprising a heat exchanger configured to cool water that has been discharged from the water discharge port, wherein the water is circulated.

The third net structure manufacturing apparatus is preferable wherein the conveying device includes a mesh-pattern belt and a drive roller.

The third net structure manufacturing apparatus is preferable wherein the conveying device is composed of at least a first conveyor and a second conveyor, and the water discharge port is provided at a position that includes an intersection between a bottom of the water tank and a perpendicular line extended downward to the bottom of the water tank from a midpoint between the first conveyor and the second conveyor.

The third net structure manufacturing apparatus is preferable further comprising a net structure drawing device provided on one side of the water tank and configured to draw the net structure, wherein the conveying device is composed of at least a first conveyor and a second conveyor, the first conveyor is located on the net structure drawing device side relative to the second conveyor, and the water discharge port is located on the net structure drawing device side relative to the first conveyor.

The third net structure manufacturing apparatus is preferable wherein further comprising a net structure drawing device provided on one side of the water tank and configured to draw the resin as the filament, wherein the conveying device is composed of at least a first conveyor and a second conveyor, the first conveyor is located on the net structure drawing device side relative to the second conveyor, and the water discharge port is located on a side that is opposite, across the second conveyor, to the net structure drawing device side.

The third net structure manufacturing apparatus is preferable wherein a shape of the water discharge port as seen in a direction perpendicular to a water surface in the water tank is a shape of a rectangle.

The third net structure manufacturing apparatus is preferable further comprising water discharge amount adjusting means configured to adjust an amount of water discharge from the water discharge port.

The third net structure manufacturing apparatus is preferable wherein the water discharge amount adjusting means increases the amount of water discharge from the water discharge port in accordance with increase in an amount of the resin extruded from the nozzle.

The third net structure manufacturing apparatus is preferable wherein the water discharge amount adjusting means increases the amount of water discharge from the water discharge port in accordance with increase in a speed of the conveying device.

A method for manufacturing a third net structure manufacturing apparatus of the present invention that has solved the above problems comprising the steps of causing melted thermoplastic resin to be extruded so as to be formed as a filament; conveying, in a water tank, a net structure having a resin as the filament by conveyance means; discharging water in the water tank from a water discharge port provided in a bottom portion of the water tank; and supplying, into the water tank, water that has a lower temperature than the water discharged from the water discharge port.

A method for manufacturing a third net structure manufacturing apparatus is preferable wherein the water discharged from the water discharge port is cooled by a heat exchanger, to be supplied into the water tank and circulated.

Effects of the Invention

In the first net structure manufacturing apparatus according to the present invention, the gas ejection device provided to the water tank ejects gas, whereby convection can be caused for water in the water tank, and it becomes easy to evenly cool the surface portion and the inside of the net structure. Therefore, a net structure in which unevenness in cooling is less likely to occur in the thickness direction of the net structure and which has sufficient durability, can be manufactured.

In the second net structure manufacturing apparatus according to the present invention, the water ejection device provided to the water tank ejects water, and the net structure located between the conveyors is not present on the extension line of the ejection direction of water from the water ejection device, whereby convection is caused for water in the water tank, and it becomes easy to evenly cool the surface portion and the inside of the net structure. As a result, a net structure in which unevenness in cooling is less likely to occur in the thickness direction of the net structure and which has sufficient durability, can be manufactured.

In the third net structure manufacturing apparatus according to the present invention, the water discharge port is provided in the bottom portion of the water tank, and water in the water tank is discharged from the water discharge port, whereby water that has an increased temperature and that is near the resin as the filament in the water tank, particularly, on the inside of the net structure, is discharged, and it is possible to prevent increase in the temperature of the water in the entire water tank. Therefore, it becomes easy to evenly cool the surface portion and the inside of the net structure. Accordingly, a net structure in which unevenness in cooling is less likely to occur in the thickness direction of the net structure and which has sufficient durability, can be manufactured.

BRIEF DESCRIPTION OF THE DRAWINGS

FIG. 1 is a side view (partial cross-sectional view) of a first net structure manufacturing apparatus according to an embodiment of the present invention.

FIG. 2 is a side view (partial cross-sectional view) of an example of a second net structure manufacturing apparatus according to the embodiment of the present invention.

FIG. 3 is a side view (partial cross-sectional view) of another example of the second net structure manufacturing apparatus according to the embodiment of the present invention.

FIG. 4 is a side view (partial cross-sectional view) of an example of a third net structure manufacturing apparatus according to the embodiment of the present invention.

FIG. 5 is a side view (partial cross-sectional view) of another example of the third net structure manufacturing apparatus according to the embodiment of the present invention.

FIG. 6 is a side view (partial cross-sectional view) of still another example of the third net structure manufacturing apparatus according to the embodiment of the present invention.

MODE FOR CARRYING OUT THE INVENTION

Hereinafter, the present invention will be specifically described with reference to the drawings. However, the present invention is not limited to the examples shown in the drawings, and can also be carried out with appropriate modifications being made within the range of the gist described above and below, and any of these modifications are included in the technical scope of the present invention.

A first net structure manufacturing apparatus according to the present invention will be described below.

The first net structure manufacturing apparatus according to the present invention includes: a nozzle having a discharge hole from which melted thermoplastic resin is extruded so as to be formed as a filament; a water tank disposed below the nozzle; a conveying device provided to the water tank and configured to convey a net structure having a resin as the filament; and a gas ejection device provided to the water tank and configured to eject gas.

A net structure of the present invention is a structure having a three-dimensional random loop-bonded configuration, in which a resin as a filament which is a thermoplastic resin is curled to form random loops and the loops in a melted state are brought into contact with and bonded to one another.

FIG. 1 is a side view of the first net structure manufacturing apparatus according to an embodiment of the present invention. A net structure manufacturing apparatus 1 includes a nozzle 10, a water tank 20, a conveying device 30, and a gas ejection device 40.

The nozzle 10 has a discharge hole 11 from which melted thermoplastic resin is extruded so as to be formed as a filament. Specifically, a thermoplastic resin melted by being heated is extruded from the discharge hole 11 of the nozzle 10, whereby a resin 12 as the filament is formed.

The number of discharge holes 11 of the nozzle 10 may be one or may be two or more. In a case where the nozzle 10 has a plurality of the discharge holes 11, the plurality of the discharge holes 11 may be arranged in one row, but are preferably arranged in a plurality of rows. If the nozzle 10 has the plurality of the discharge holes 11, a plurality of resins 12 as filaments can be formed at the same time, whereby production efficiency for the net structure 60 can be improved. The number of discharge holes 11 of the nozzle 10 can be adjusted according to the hardness and the cushioning performance of the net structure 60 to be manufactured.

The cross-sectional shape of an outlet of the discharge hole 11 is not particularly limited, and examples of the cross-sectional shape include the shapes of a circle, an ellipse, and a polygon. Among these shapes, the cross-sectional shape of the outlet of the discharge hole 11 is preferably the shape of a circle or an ellipse. If the discharge hole 11 is thus configured, a cross-sectional shape of the resin 12 as the filament extruded from the discharge hole 11 is also the shape of the circle or the ellipse. Therefore, when the aforementioned three-dimensional random loop-bonded configuration is formed, the area in which the resins 12 as the filaments come into contact with one another is increased, and a net structure 60 having high elasticity and durability can be manufactured.

The cross-sectional shape of the resin 12 as the filament extruded from the discharge hole 11 may be a solid shape or a hollow shape. For causing the cross-sectional shape of the resin 12 as the filament to be a hollow shape, for example, a nozzle in which a core portion such as a core rod is provided inside the discharge hole 11 may be used. Specific examples of the nozzle include: a so-called C-type nozzle in which the outlet of a discharge hole 11 has a cross-sectional shape in which the inner side and the outer side of the discharge hole 11 are in partial communication with each other; and a so-called three-point bridge-shaped nozzle in which a bridge is provided to the discharge hole 11 so as to divide the discharge hole 11 in the circumferential direction.

The length in the longitudinal direction of the cross-sectional shape of the outlet of the discharge hole 11 is preferably not smaller than 0.1 mm, more preferably not smaller than 0.5 mm, and further preferably not smaller than 1.0 mm. If the lower limit value for the length in the longitudinal direction of the cross-sectional shape of the outlet of the discharge hole 11 is thus set, the durability of the net structure 60 is improved, and the net structure 60 can be made capable of enduring repetitive compression. Meanwhile, the length in the longitudinal direction of the cross-sectional shape of the outlet of the discharge hole 11 is preferably not larger than 10 mm, more preferably not larger than 7 mm, and further preferably not larger than 5 mm. If the upper limit value for the length in the longitudinal direction of the cross-sectional shape of the outlet of the discharge hole 11 is thus set, a net structure 60 having favorable cushioning performance can be manufactured.

In the case where the nozzle 10 has a plurality of the discharge holes 11, the sizes of the cross-sectional shapes of the outlets of the discharge holes 11 may be the same as or different from one another. If the sizes of the cross-sectional shapes of the outlets of all the discharge holes 11 of the nozzle 10 are set to be the same as one another, a net structure 60 in which the resins 12 as the filaments have equal thicknesses can be obtained. Meanwhile if, for example, the size of the cross-sectional shape of the outlet of the discharge hole 11 at the center of the nozzle 10 is set to be smaller than the sizes of the cross-sectional shapes of the outlets of the discharge holes 11 surrounding the discharge hole 11, the resin 12 as the filament inside the net structure 60 becomes thinner than the resins 12 as the filaments at the surface portion of the net structure 60, and thus the temperature of the net structure 60 becomes more likely to decrease on the inside thereof than on the surface portion thereof. Therefore, a net structure 60 having a configuration in which unevenness in cooling is less likely to occur, can be manufactured.

Examples of the thermoplastic resin to be extruded from the discharge hole 11 include a polyester-based thermoplastic elastomer, a polyolefin-based thermoplastic elastomer, a polystyrene-based thermoplastic elastomer, a polyurethane-based thermoplastic elastomer, a polyamide-based thermoplastic elastomer, and an ethylene-vinyl acetate copolymer. The thermoplastic resin preferably contains, among these thermoplastic resins, at least any of a polyester-based thermoplastic elastomer, a polyolefin-based thermoplastic elastomer, and a polystyrene-based thermoplastic elastomer. If the thermoplastic resin contains at least any of a polyester-based thermoplastic elastomer, a polyolefin-based thermoplastic elastomer, and a polystyrene-based thermoplastic elastomer, processability is improved, and the net structure 60 becomes easy to manufacture. The thermoplastic resin more preferably contains a polyester-based thermoplastic elastomer. If the thermoplastic resin contains a polyester-based thermoplastic elastomer, repeated compression residual strain can be made low. In addition, if the thermoplastic resin contains a polyester-based thermoplastic elastomer, the hardness retention rate of the net structure 60 after repeated compression can be made high, and a net structure 60 having high durability can be manufactured The water tank 20 is disposed below the nozzle 10 and configured to be able to receive the resin 12 as the filament extruded from the discharge hole 11 of the nozzle 10. The water tank 20 contains water for cooling the resin 12 as the filament extruded from the discharge hole 11 of the nozzle 10. The resin 12 as the filament extruded from the discharge hole 11 of the nozzle 10 comes down on the water surface in the water tank 20 and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure 60 is obtained.

The conveying device 30 is provided to the water tank 20, and conveys the net structure 60 having the resin 12 as the filament. That is, the conveying device 30 conveys, in the water tank 20, the net structure 60 having the resin 12 as the filament extruded from the discharge hole 11 of the nozzle 10 and received in the water tank 20. The conveying device 30 preferably conveys the net structure 60 from the water surface in the water tank 20 toward a bottom portion of the water tank 20. The conveying device 30 is preferably provided in the water tank 20.

The type of the conveying device 30 is not particularly limited, and examples thereof include conveyors such as a belt conveyor, a net conveyor, and a slat conveyor. The details of the conveying device 30 will be described later.

The gas ejection device 40 is provided to the water tank 20 and ejects gas. The gas to be ejected by the gas ejection device 40 is preferably a gas compressed by a gas-compressing device (not shown). The gas ejection device 40 ejects gas in the water in the water tank 20, whereby convection can be caused for water in the water tank 20. When convection is caused for the water in the water tank 20, not only water near the surface portion of the net structure 60 in the water tank 20 but also water inside the net structure 60 is moved through voids in the net structure 60, and water is newly supplied. Therefore, both the surface portion and the inside of the net structure 60 in the water tank 20 can be cooled evenly, and unevenness in cooling is less likely to occur. Since unevenness in cooling is less likely to occur, it is possible to prevent, during manufacturing of the net structure 60, increase in the repeated compression residual strain and decrease in the hardness retention rate after repeated compression due to insufficient cooling. Accordingly, a net structure 60 having high durability can be manufactured. Examples of the type of the gas include air, oxygen gas, and nitrogen gas. Among these gases, air is preferable.

The gas ejection device 40 is preferably disposed below the conveying device 30. The temperature of water at a location near the water surface at which the resin 12 as the filament extruded from the discharge hole 11 of the nozzle 10 comes into contact with the water in the water tank 20, becomes highest. Thus, if the gas ejection device 40 is disposed below the conveying device 30, water that is present below the conveying device 30 and that has a lower temperature than the water at the location near the water surface can be sent to the resin 12 as the filament at the location near the water surface. Accordingly, the resin 12 as the filament at the location near the water surface can be efficiently cooled. The gas ejection device 40 may be disposed between the lower end of the conveying device 30 and the bottom of the water tank 20 or may be disposed on the bottom portion of the water tank 20.

The gas ejection device 40 has a gas ejection hole 43 from which gas is ejected, and the direction of a normal to the gas ejection hole 43 preferably extends toward the water surface in the water tank 20. The normal to the gas ejection hole 43 refers to a line that is perpendicular to a surface, of the gas ejection hole 43, that includes an opening portion. If the direction of the normal to the gas ejection hole 43 extends toward the water surface in the water tank 20, convection of water can be caused from a location near the gas ejection device 40 toward a location near the water surface having high water temperature. Accordingly, the net structure 60 can be efficiently cooled. In a case where the gas ejection device 40 has a plurality of the gas ejection holes 43, the direction of a normal to at least one of the gas ejection holes 43 preferably extends toward the water surface in the water tank 20.

The number of gas ejection holes 43 of the gas ejection device 40 may be one or may be two or more. If the number of gas ejection holes 43 is one, the direction in which gas is ejected from the gas ejection hole 43 is easily adjusted. Meanwhile, if the number of gas ejection holes 43 is two or more, gas to be ejected from the gas ejection holes 43 can be diffused, and great convection can be caused for water in the water tank 20, whereby the cooling efficiency for the net structure 60 can be improved.

In a case where, as described later, the conveying device 30 is composed of at least a first conveyor 31 and a second conveyor 32 and the net structure 60 is located between the first conveyor 31 and the second conveyor 32, the direction of the normal to the gas ejection hole 43 preferably extends toward the net structure 60 located between the conveying devices 30. That is, the direction of the normal to the gas ejection hole 43 preferably extends toward the net structure 60 located between the first conveyor 31 and the second conveyor 32. If the direction of the normal to the gas ejection hole 43 extends toward the net structure 60 located between the conveying devices 30, it becomes easier to send water to the inside of the net structure 60. Accordingly, it becomes easy to cool the inside, of the net structure 60, which is prone to insufficient cooling.

The direction of the normal to the gas ejection hole 43 more preferably extends toward the water surface in the water tank 20 and the net structure 60 located between the conveying devices 30. If the gas ejection hole 43 is thus configured, convection of water can be caused from the gas ejection device 40 through the inside of the net structure 60 toward the water surface in the water tank 20. Accordingly, unevenness in cooling becomes less likely to occur in the thickness direction of the net structure 60.

The amount of gas to be ejected by the gas ejection device 40 preferably increases in accordance with increase in the amount of the resin extruded from the nozzle 10. That is, the volume ($m^3$/min) of gas to be ejected by the gas ejection device 40 (measured value at 1 atm. and normal temperature), and the extrusion amount (g/min) of the resin extruded from the nozzle 10, are preferably associated with each other. If, for example, the amount of the resin 12 as the filament to be extruded from the nozzle 10 is increased for improving the resilience of the net structure 60, the temperature at a location near the water surface in the water tank 20 becomes more likely to be high, and thus the cooling efficiency for the net structure 60 deteriorates. In addition, if the amount of the resin 12 as the filament to be extruded from the nozzle 10 is increased, the net structure 60 is densified. Thus, the inside of the net structure 60 becomes less likely to be cooled, and unevenness in cooling becomes likely to occur in the thickness direction of the net structure 60. Therefore, if the ejection amount of gas from the gas ejection device 40 is increased in association with increase in the amount of the resin 12 as the filament extruded from the nozzle 10, convection of water in the water tank 20 is increased. Accordingly, it is possible to improve the cooling efficiency for the net structure 60, and prevent unevenness in cooling.

The volume ($m^3$/min) of gas to be ejected by the gas ejection device 40 (measured value at 1 atm. and normal temperature) is more preferably proportional to the extrusion amount (g/min) of the resin from the nozzle 10. If the volume of gas to be ejected by the gas ejection device 40 and the extrusion amount of the resin from the nozzle 10 are in such a relationship, the cooling efficiency for the net structure 60 can be further improved, and unevenness in cooling becomes less likely to occur.

It is also preferable that the amount of gas to be ejected by the gas ejection device 40 increases in accordance with increase in the speed of the conveying device 30. That is, the volume ($m^3$/min) of gas to be ejected by the gas ejection device 40 (measured value at 1 atm. and normal temperature), and the speed of conveying the net structure 60 by the conveying device 30, are preferably associated with each other. If the speed of the conveying device 30 is increased for the purpose of, for example, reducing the density of the net structure 60 in order to reduce the hardness of the net structure 60, transition to a next step occurs while the inside of the net structure 60 is left insufficiently cooled. If transition to a next step occurs in a state where the inside of the net structure 60 is left insufficiently cooled, a net structure 60 that, on the inside thereof, has a high repeated compression residual strain and has a low hardness retention rate after repeated compression and that is inferior in durability, might be obtained. Therefore, if the ejection amount of gas from the gas ejection device 40 is increased in association with increase in the speed of the conveying device 30, convection of water in the water tank 20 is increased. Accordingly, it is possible to improve the cooling efficiency for the net structure 60, and sufficiently cool not only the surface portion but also the inside of the net structure 60.

The volume ($m^3$/min) of gas to be ejected by the gas ejection device 40 (measured value at 1 atm. and normal temperature) is more preferably proportional to the speed (m/min) of the conveying device 30. If the volume of gas to be ejected by the gas ejection device 40 and the speed of the conveying device 30 are in such a relationship, it is possible to further improve the cooling efficiency for the net structure 60, and prevent occurrence of unevenness in cooling.

It is more preferable that the amount of gas to be ejected by the gas ejection device 40 increases in accordance with increase in the amount of the resin extruded from the nozzle 10 and increases in accordance with increase in the speed of the conveying device 30. That is, the volume ($m^3$/min) of gas to be ejected by the gas ejection device 40 (measured value at 1 atm. and normal temperature) is more preferably proportional to the extrusion amount (g/min) of the resin from the nozzle 10 and the speed (m/min) of the conveying device 30. If the amount of gas to be ejected by the gas ejection device 40 is thus set, even when, for example, the amount of the resin 12 as the filament to be extruded from the nozzle 10 is increased and the speed of the conveying device 30 is increased for the purpose of, for example, improving the productivity for the net structure 60, the net structure 60 can be sufficiently cooled and unevenness in cooling can be made less likely to occur in the thickness direction of the net structure 60, by increasing the convection of water in the water tank 20.

The upper end of the conveying device 30 is preferably located above the water surface in the water tank 20. If the conveying device 30 is thus disposed, when the resin 12 as the filament extruded from the discharge hole 11 of the nozzle 10 comes into contact with the water in the water tank 20, the resin 12 as the filament can be prevented from freely moving on the water surface, and the thickness of the net structure 60 can be prevented from excessively increasing.

The conveying device 30 preferably includes a conveyor belt 33. Examples of the conveyor belt 33 include: a flat belt made of rubber or resin; a net conveyor belt obtained by continuously knitting or weaving metallic wires so as to have a mesh pattern; and a slat conveyor belt in which metallic slats are continuously attached to conveyor chains.

Among these conveyor belts, the conveyor belt 33 is preferably a net conveyor belt because of favorable holding performance thereof and excellent water permeability thereof. That is, the conveying device 30 is, as the conveying device, preferably a net conveyor having a mesh-pattern belt and a drive roller 34. If the conveying device 30 is thus configured, water and gas can pass through the conveying device 30. Accordingly, convection of water in the water tank 20 caused by the gas ejection device 40 is less likely to be hindered by the conveying device 30, whereby the cooling efficiency for the net structure 60 can be improved.

The conveyor belt 33 is preferably endless. If the conveyor belt 33 is formed so as to be endless, the endless conveyor belt 33 is rotated in an uninterrupted manner by rotation of the drive roller 34, whereby the conveying device 30 can be continuously operated. As a result, the net structure 60 can be efficiently conveyed.

It is preferable that the number of drive rollers 34 is two or more and the drive rollers 34 are disposed at an upper portion and a lower portion of the inside of the endless conveyor belt 33. That is, it is preferable that an upper drive roller 34*a* is disposed at an upper portion of the inside of the conveyor belt 33 and a lower drive roller 34*b* is disposed at a lower portion of the inside of the conveyor belt 33. If the drive rollers 34 are thus configured, the conveyor belt 33 becomes less likely to be distorted, and it is possible to prevent the conveyor belt 33 from idling upon rotation of the drive rollers 34, thereby preventing the conveying device 30 from malfunctioning.

It is preferable that the conveying device 30 is composed of at least the first conveyor 31 and the second conveyor 32, and the net structure 60 is located between the first conveyor 31 and the second conveyor 32. If the conveying device 30 is thus configured, the net structure 60 can be conveyed in a state of being held between the first conveyor 31 and the second conveyor 32. Accordingly, a net structure 60 having a smooth surface and having a uniform thickness can be obtained.

The distance between the lower drive roller 34*b* of the first conveyor 31 and the lower drive roller 34*b* of the second conveyor 32 is preferably shorter than the distance between the upper drive roller 34*a* of the first conveyor 31 and the upper drive roller 34*a* of the second conveyor 32. That is, it is preferable that the distance between the first conveyor 31 and the second conveyor 32 is shorter at lower portions thereof than at upper portions thereof and becomes shorter toward the lower portions. If the conveying device 30 is thus configured, the net structure 60 can be held between the lower portions of the conveying device 30. As a result, it becomes easy to lead the resin 12 as the filament and the net structure 60 into the water tank 20, and thus it becomes easy to cool the net structure 60.

The net structure manufacturing apparatus 1 preferably includes a net structure drawing device 50 configured to draw the net structure 60 so as to pull it up from the water tank 20. If the net structure manufacturing apparatus 1 includes the net structure drawing device 50, after the net structure 60 is cooled, the net structure 60 can be automatically pulled up from the water tank 20 and transition to a drying step for the net structure 60 can be performed, whereby the productivity for the net structure 60 can be increased.

It is preferable that the net structure drawing device 50 configured to draw the net structure 60 is disposed on one side of the water tank 20, the conveying device 30 is composed of at least the first conveyor 31 and the second conveyor 32, and the gas ejection device 40 is located on the net structure drawing device 50 side relative to a vertical plane p1 that includes a midpoint P1 between the first conveyor 31 and the second conveyor 32. In the water tank 20, the net structure 60 is present on the net structure drawing device 50 side relative to the vertical plane p1. Thus, in terms of efficient cooling of the net structure 60, convection of water is preferably caused to a greater extent on the net structure drawing device 50 side relative to the vertical plane p1 than on a side that is opposite, across the vertical plane p1, to the net structure drawing device 50 side. Therefore, if the gas ejection device 40 is thus disposed, convection can be more efficiently caused for water near the net structure 60, whereby the cooling efficiency for the net structure 60 can be improved.

It is preferable that the gas ejection device 40 is composed of at least a first gas ejector 41 and a second gas ejector 42, the conveying device 30 is composed of at least the first conveyor 31 and the second conveyor 32, the first gas ejector 41 is disposed vertically below the first conveyor 31, and the second gas ejector 42 is disposed vertically below the second conveyor 32. If the first gas ejector 41 and the second gas ejector 42 are thus disposed, convection of water can be caused on both sides of the net structure 60. Therefore, not only water near the net structure 60 but also the water in the entire water tank 20 can be moved, whereby the cooling efficiency for the net structure 60 can be further improved.

The direction of a normal to the gas ejection hole 43 of the first gas ejector 41 may be the same as or different from the direction of a normal to the gas ejection hole 43 of the second gas ejector 42. If, for example, the direction of the normal to the gas ejection hole 43 of the first gas ejector 41 is the vertical direction toward the water surface and the direction of the normal to the gas ejection hole 43 of the second gas ejector 42 is also the vertical direction toward the water surface, convection of water can be caused evenly on both sides of the net structure 60 in the water tank 20, whereby convection can be caused so as to be balanced between the first gas ejector 41 and the second gas ejector 42. Meanwhile, if the direction of the normal to the gas ejection hole 43 of the first gas ejector 41 and the direction of the normal to the gas ejection hole 43 of the second gas ejector 42 are different from each other, the first gas ejector 41 and the second gas ejector 42 can cause convection of water at respective different locations, and thus can preferentially cause convection at respective locations at which convection is desired to be caused.

It is also preferable that, as shown in FIG. 1, the direction of the normal to the gas ejection hole 43 of the first gas ejector 41 and the direction of the normal to the gas ejection hole 43 of the second gas ejector 42 extend toward a location between the center point of the upper drive roller 34*a* of the first conveyor 31 and the center point of the upper drive roller 34*a* of the second conveyor 32. If the first gas ejector 41 and the second gas ejector 42 are thus configured, convection can be efficiently caused at a location at which the water temperature becomes highest in the water tank 20 and at which the resin 12 as the filament extruded from the discharge hole 11 of the nozzle 10 comes into contact with water in the water tank 20. Accordingly, the net structure 60 can be efficiently cooled.

The distance between the first gas ejector 41 and the bottom of the water tank 20 may be equal to or different from the distance between the second gas ejector 42 and the bottom of the water tank 20. Specifically, the distance between the gas ejection hole 43 of the first gas ejector 41 and the bottom of the water tank 20 may be equal to or different from the distance between the gas ejection hole 43 of the second gas ejector 42 and the bottom of the water tank 20. If the distance between the first gas ejector 41 and the bottom of the water tank 20 is equal to the distance between the second gas ejector 42 and the bottom of the water tank 20, the extent of convection to be caused by the first gas ejector 41 and the extent of convection to be caused by the second gas ejector 42 can be set to be the same as each other. Therefore, convection can be caused in the water tank 20 so as to be balanced between the first gas ejector 41 and the second gas ejector 42.

Meanwhile, if the distance between the first gas ejector 41 and the bottom of the water tank 20 is different from the distance between the second gas ejector 42 and the bottom of the water tank 20, specifically, if the distance between the first gas ejector 41 and the bottom of the water tank 20 is longer than the distance between the second gas ejector 42 and the bottom of the water tank 20 with the first gas ejector 41 being disposed on a side where the net structure drawing device 50 is disposed, the first gas ejector 41 is located closer to the resin 12 as the filament. Accordingly, convection can be caused more greatly at a location near the net structure 60, whereby the cooling efficiency for the net structure 60 can be improved.

The amount of gas to be ejected by the first gas ejector 41 may be equal to or different from the amount of gas to be ejected by the second gas ejector 42. If the amount of gas to be ejected by the first gas ejector 41 is equal to the amount of gas to be ejected by the second gas ejector 42, convection can be caused for water in the water tank 20 such that the extent of the convection becomes the same between the first gas ejector 41 and the second gas ejector 42, whereby convection can be caused in a balanced manner in the water tank 20.

Meanwhile, if the amount of gas to be ejected by the first gas ejector 41 is different from the amount of gas to be ejected by the second gas ejector 42, specifically, if the amount of gas to be ejected by the first gas ejector 41 is larger than the amount of gas to be ejected by the second gas ejector 42 with the first gas ejector 41 being disposed at the side where the net structure drawing device 50 is disposed, convection of water caused by the first gas ejector 41 closer to the net structure 60 can be set to be greater, whereby the net structure 60 can be efficiently cooled.

The water in the water tank 20 may be discharged, and low-temperature water may be newly supplied into the water tank 20. Although not shown in figure, the discharge of the water from the water tank 20 may be performed by so-called overflow in which the water is discharged from a tube or the like disposed at an upper portion of the water tank 20. Specific examples of such discharge include discharge in which low-temperature water is newly supplied into the water tank 20 from a lower portion of the water tank 20 and water that has an increased temperature is caused to overflow.

A first net structure manufacturing method according to the present invention includes the steps of; causing melted thermoplastic resin to be extruded so as to be formed as a filament; conveying, in a water tank, a net structure having a resin as the filament by conveyance means; and ejecting gas into water in the water tank by a gas ejection device.

A thermoplastic resin which is a material for a net structure is heated and melted, and the resin is extruded so as to be formed as a filament. For forming the resin as a filament, extrusion of melted thermoplastic resin from a nozzle or the like having a discharge hole, or the like, may be performed.

The extruded resin as the filament is received in a water tank storing water therein. The resin as the filament comes down on the water surface in the water tank and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure is formed.

The net structure is conveyed inside the water tank by conveyance means. The conveyance means preferably conveys the net structure downward from the water surface in the water tank. If the net structure is conveyed by such conveyance means, the extruded resin as the filament is continuously formed as a sheet-like net structure. Thus, a net structure having such a size as to be suitable as a cushion material for beddings and seats can be manufactured. As the conveyance means, for example, a conveying device such as any of the aforementioned conveyors can be used.

Gas is ejected into the water in the water tank by the gas ejection device. By ejecting gas in the water, convection is caused for water in the water tank, water that is present at a location near the water surface and that has an increased temperature is moved, and low-temperature water is supplied. Accordingly, it is possible to efficiently cool the net structure, and sufficiently cool not only the surface portion but also the inside of the net structure. Therefore, a net structure in which unevenness in cooling is less likely to occur and which has high durability, can be manufactured.

The net structure after the cooling is pulled up from the water tank and dried, whereby a net structure can be manufactured. It is preferable to perform, before and after drying the net structure, pseudo-crystallization in which heating is performed for a certain time at a temperature lower than the melting point of the resin used as the material of the net structure. If pseudo-crystallization is performed on the net structure, the durability of the net structure can be improved. It is considered that, in pseudo-crystallization, hard segments of the resin are rearranged by the heating, a metastable intermediate phase is formed, and pseudocrystal-like crosslinking points are formed, whereby the durabilities of the net structure such as heat resistance and sag resistance are improved.

As described above, the first net structure manufacturing apparatus according to the present invention includes: the nozzle having the discharge hole from which melted thermoplastic resin is extruded so as to be formed as a filament; the water tank disposed below the nozzle; the conveying device provided to the water tank and configured to convey a net structure having a resin as the filament; and the gas ejection device provided to the water tank and configured to eject gas. Since the net structure manufacturing apparatus has this configuration, the gas ejection device provided to the water tank discharges gas, and thus can cause convection for water in the water tank, whereby it becomes easy to efficiently cool the surface portion and the inside of the net structure. Therefore, it is possible to provide a manufacturing apparatus for manufacturing a net structure in which unevenness in cooling is less likely to occur in the thickness direction of the net structure and which has sufficient durability.

A second net structure manufacturing apparatus according to the present invention will be described below.

The second net structure manufacturing apparatus according to the present invention includes: a nozzle having a discharge hole from which melted thermoplastic resin is extruded so as to be formed as a filament; a water tank disposed below the nozzle; a conveying device provided to the water tank and configured to convey a net structure having a resin as the filament; and a water ejection device provided to the water tank and configured to eject water in a predetermined direction. The conveying device is composed of at least a first conveyor and a second conveyor. The net structure is located between the first conveyor and the second conveyor. The net structure located between the conveyors is not present on an extension line of an ejection direction of water from the water ejection device.

A net structure of the present invention is a structure having a three-dimensional random loop-bonded configuration, in which a resin as a filament which is a thermoplastic resin is curled to form random loops and the loops in a melted state are brought into contact with and bonded to one another.

FIGS. 2 and 3 are a side view of the first net structure manufacturing apparatus according to an embodiment of the present invention. A net structure manufacturing apparatus 1 includes a nozzle 10, a water tank 20, a conveying device 30, and a water ejection device 70.

The nozzle 10 has a discharge hole 11 from which melted thermoplastic resin is extruded so as to be formed as a filament. Specifically, a thermoplastic resin melted by being heated is extruded from the discharge hole 11 of the nozzle 10, whereby a resin 12 as the filament is formed.

The number of discharge holes 11 of the nozzle 10 may be one or may be two or more. In a case where the nozzle 10 has a plurality of the discharge holes 11, the plurality of the discharge holes 11 may be arranged in one row, but are preferably arranged in a plurality of rows. If the nozzle 10 has the plurality of the discharge holes 11, a plurality of resins 12 as filaments can be formed at the same time, whereby production efficiency for the net structure 60 can be improved. The number of discharge holes 11 of the nozzle 10 can be adjusted according to the hardness and the cushioning performance of the net structure 60 to be manufactured.

The cross-sectional shape of an outlet of the discharge hole 11 is not particularly limited, and examples of the cross-sectional shape include the shapes of a circle, an ellipse, and a polygon. Among these shapes, the cross-sectional shape of the outlet of the discharge hole 11 is preferably the shape of a circle or an ellipse. If the discharge hole 11 is thus configured, a cross-sectional shape of the resin 12 as the filament extruded from the discharge hole 11 is also the shape of the circle or the ellipse. Therefore, when the aforementioned three-dimensional random loop-bonded configuration is formed, the area in which the resins 12 as the filaments come into contact with one another is increased, and a net structure 60 having high elasticity and durability can be manufactured.

The cross-sectional shape of the resin 12 as the filament extruded from the discharge hole 11 may be a solid shape or a hollow shape. For causing the cross-sectional shape of the resin 12 as the filament to be a hollow shape, for example, a nozzle in which a core portion such as a core rod is provided inside the discharge hole 11 may be used. Specific examples of the nozzle include: a so-called C-type nozzle in which the outlet of a discharge hole 11 has a cross-sectional shape in which the inner side and the outer side of the discharge hole 11 are in partial communication with each other; and a so-called three-point bridge-shaped nozzle in which a bridge is provided to the discharge hole 11 so as to divide the discharge hole 11 in the circumferential direction.

The length in the longitudinal direction of the cross-sectional shape of the outlet of the discharge hole 11 is preferably not smaller than 0.1 mm, more preferably not smaller than 0.5 mm, and further preferably not smaller than 1.0 mm. If the lower limit value for the length in the longitudinal direction of the cross-sectional shape of the outlet of the discharge hole 11 is thus set, the durability of the net structure 60 is improved, and the net structure 60 can be made capable of enduring repetitive compression. Meanwhile, the length in the longitudinal direction of the cross-sectional shape of the outlet of the discharge hole 11 is preferably not larger than 10 mm, more preferably not larger than 7 mm, and further preferably not larger than 5 mm. If the upper limit value for the length in the longitudinal direction of the cross-sectional shape of the outlet of the discharge hole 11 is thus set, a net structure 60 having favorable cushioning performance can be manufactured.

In the case where the nozzle 10 has a plurality of the discharge holes 11, the sizes of the cross-sectional shapes of the outlets of the discharge holes 11 may be the same as or different from one another. If the sizes of the cross-sectional shapes of the outlets of all the discharge holes 11 of the nozzle 10 are set to be the same as one another, a net structure 60 in which the resins 12 as the filaments have equal thicknesses can be obtained. Meanwhile if, for example, the size of the cross-sectional shape of the outlet of the discharge hole 11 at the center of the nozzle 10 is set to be smaller than the sizes of the cross-sectional shapes of the outlets of the discharge holes 11 surrounding the discharge hole 11, the resin 12 as the filament inside the net structure 60 becomes thinner than the resins 12 as the filaments at the surface portion of the net structure 60, and thus the temperature of the net structure 60 becomes more likely to decrease on the inside thereof than on the surface portion thereof. Therefore, a net structure 60 having a configuration in which unevenness in cooling is less likely to occur, can be manufactured.

Examples of the thermoplastic resin to be extruded from the discharge hole 11 include a polyester-based thermoplastic elastomer, a polyolefin-based thermoplastic elastomer, a polystyrene-based thermoplastic elastomer, a polyurethane-based thermoplastic elastomer, a polyamide-based thermoplastic elastomer, and an ethylene-vinyl acetate copolymer. The thermoplastic resin preferably contains, among these thermoplastic resins, at least any of a polyester-based thermoplastic elastomer, a polyolefin-based thermoplastic elastomer, and a polystyrene-based thermoplastic elastomer. If the thermoplastic resin contains at least any of a polyester-based thermoplastic elastomer, a polyolefin-based thermoplastic elastomer, and a polystyrene-based thermoplastic elastomer, processability is improved, and the net structure 60 becomes easy to manufacture. The thermoplastic resin more preferably contains a polyester-based thermoplastic elastomer. If the thermoplastic resin contains a polyester-based thermoplastic elastomer, repeated compression residual strain can be made low. In addition, if the thermoplastic resin contains a polyester-based thermoplastic elastomer, the hardness retention rate of the net structure 60 after repeated compression can be made high, and a net structure 60 having high durability can be manufactured.

The water tank 20 is disposed below the nozzle 10 and configured to be able to receive the resin 12 as the filament extruded from the discharge hole 11 of the nozzle 10. The water tank 20 contains water for cooling the resin 12 as the filament extruded from the discharge hole 11 of the nozzle 10. The resin 12 as the filament extruded from the discharge hole 11 of the nozzle 10 comes down on the water surface in the water tank 20 and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure 60 is obtained.

The conveying device 30 is provided to the water tank 20, and conveys the net structure 60 having the resin 12 as the filament. That is, the conveying device 30 conveys, in the water tank 20, the net structure 60 having the resin 12 as the filament extruded from the discharge hole 11 of the nozzle 10 and received in the water tank 20. The conveying device 30 preferably conveys the net structure 60 from the water surface in the water tank 20 toward a bottom portion of the water tank 20. The conveying device 30 is preferably provided in the water tank 20.

It is preferable that the conveying device 30 is composed of at least the first conveyor 31 and the second conveyor 32, and the net structure 60 is located between the first conveyor 31 and the second conveyor 32. If the conveying device 30 is thus configured, the net structure 60 can be conveyed in a state of being held between the first conveyor 31 and the second conveyor 32. Accordingly, a net structure 60 having a smooth surface and having a uniform thickness can be obtained.

The type of the conveying device 30 is not particularly limited, and examples thereof include conveyors such as a belt conveyor, a net conveyor, and a slat conveyor. The details of the conveying device 30 will be described later.

The water ejection device 70 is provided to the water tank 20, and ejects water in a predetermined direction. The net structure 60 located between the conveying devices 30 is not present on an extension line of an ejection direction of water from the water ejection device 70. Since the water ejection device 70 ejects water inside the water in the water tank 20 and the net structure 60 located between the conveying devices 30 is not present on the extension line of the ejection direction of water, the water ejection device 70 causes convection for water in the water tank 20 to cool the net structure 60 with this water, instead of bringing water into direct contact with the surface portion of the net structure 60 to cool the net structure 60. Accordingly, both the surface portion and the inside of the net structure 60 in the water tank 20 can be cooled evenly, and unevenness in cooling is less likely to occur. A conventional manufacturing apparatus in which water is brought into contact with the surface portion of the net structure 60 to cool the net structure 60, has a problem in that unevenness in cooling occurs in the thickness direction of the net structure 60, whereby, at a portion having been insufficiently cooled, the repeated compression residual strain is increased, and the hardness retention rate after repeated compression is reduced. In contrast, in the net structure manufacturing apparatus 1, unevenness in cooling is less likely to occur, and thus it is possible to prevent increase in the repeated compression residual strain and decrease in the hardness retention rate after repeated compression, whereby a net structure 60 having high durability can be manufactured.

The ejection direction of water from the water ejection device 70 preferably extends toward the water surface in the water tank 20. The temperature of water at a location near the water surface at which the resin 12 as the filament extruded from the discharge hole 11 of the nozzle 10 comes into contact with the water in the water tank 20, becomes highest. Thus, if the ejection direction of water extends toward the water surface, water having a lower temperature than the water at a location near the water surface can be sent to the location near the water surface. Accordingly, the net structure 60 can be efficiently cooled.

The ejection direction of water from the water ejection device 70 more preferably extends toward the net structure 60 relative to the vertical direction. That is, it is more preferable that the ejection direction of water from the water ejection device 70 extends toward the water surface in the water tank 20 and extends toward the net structure 60 located between the conveyors relative to the vertical direction perpendicular to the water surface in the water tank 20. If the ejection direction of water from the water ejection device 70 is thus set, low-temperature water can be more efficiently sent to a location near the water surface at which the water temperature becomes highest and at which the resin 12 as the filament extruded from the discharge hole 11 of the nozzle 10 comes into contact with the water in the water tank 20. As a result, it becomes easy to evenly cool the surface portion and the inside of the net structure 60.

The water ejection device 70 preferably has a water ejection hole 73 from which water is ejected, and the water ejection hole 73 is preferably disposed below the water surface in the water tank 20 by not less than 0.1 mm, more preferably by not less than 1 mm, and further preferably by not less than 10 mm. If the lower limit value for the distance D1 between the water ejection hole 73 and the water surface in the water tank 20 is set as described above, convection can be sufficiently caused for water in the water tank 20, whereby the cooling efficiency for the net structure 60 can be improved. Meanwhile, the water ejection hole 73 is preferably disposed below the water surface in the water tank 20 by not greater than 400 mm, more preferably by not greater than 350 mm, further preferably by not greater than 300 mm, and most preferably by not greater than 250 mm. If the upper limit value for the distance D1 between the water ejection hole 73 and the water surface in the water tank 20 is set as described above, convection of water can be caused from the water ejection device 70 toward a location near the water surface having high water temperature. The location near the water surface is the location at which the difference in the extent of cooling between the surface portion and the inside of the net structure 60 is largest. If convection of water is caused at the location near the water surface, the net structure 60 can be cooled more evenly. In a case where the water ejection device 70 has a plurality of water ejection holes 73, the distance D1 between at least one of the water ejection holes 73 and the water surface in the water tank 20 is preferably set as described above.

The number of water ejection holes 73 of the water ejection device 70 may be one or may be two or more. If the number of water ejection holes 73 is one, the direction of water to be ejected from the water ejection hole 73 is easily adjusted. Meanwhile, if the number of water ejection holes 73 is two or more, water ejected from the water ejection holes 73 can be diffused, and great convection can be caused for water in the water tank 20. Accordingly, the cooling efficiency for the net structure 60 can be improved.

The water ejection device 70 is preferably disposed inside the conveying device 30. If the water ejection device 70 is thus disposed, water ejected from the water ejection device 70 is less likely to come into direct contact with the net structure 60, and convection of water can be further efficiently caused at the location near the water surface at which the water temperature becomes high. Accordingly, the surface portion and the inside of the net structure 60 can be cooled more evenly and efficiently.

The upper end of the conveying device 30 is preferably located above the water surface in the water tank 20. If the conveying device 30 is thus disposed, when the resin 12 as the filament extruded from the discharge hole 11 of the nozzle 10 comes into contact with the water in the water tank 20, the resin 12 as the filament can be prevented from freely moving on the water surface, and the thickness of the net structure 60 can be prevented from excessively increasing.

The conveying device 30 preferably includes the conveyor belt 33 and the drive roller 34. Examples of the conveyor belt 33 include: a flat belt made of rubber or resin; a net conveyor belt obtained by continuously knitting or weaving metallic wires so as to have a mesh pattern; and a slat conveyor belt in which metallic slats are continuously attached to conveyor chains.

Among these conveyor belts, the conveyor belt 33 is preferably a net conveyor belt because of favorable holding performance thereof and excellent water permeability thereof. That is, the conveying device 30 is, as the conveying device, preferably a net conveyor having a mesh-pattern belt and a drive roller. If the conveying device 30 is thus configured, water can pass through the conveying device 30. Accordingly, convection of water in the water tank 20 caused by the water ejection device 70 is less likely to be hindered by the conveying device 30, whereby the cooling efficiency for the net structure 60 can be improved.

The conveyor belt 33 is preferably endless. If the conveyor belt 33 is formed so as to be endless, the endless conveyor belt 33 is rotated in an uninterrupted manner by rotation of the drive roller 34, whereby the conveying device 30 can be continuously operated. As a result, the net structure 60 can be efficiently conveyed.

It is preferable that the number of drive rollers 34 is two or more and the drive rollers 34 are disposed at an upper portion and a lower portion of the inside of the endless conveyor belt 33. That is, it is preferable that an upper drive roller 34*a* is disposed at an upper portion of the inside of the conveyor belt 33 and a lower drive roller 34*b* is disposed at a lower portion of the inside of the conveyor belt 33. If the drive rollers 34 are thus configured, the conveyor belt 33 becomes less likely to be distorted, and it is possible to prevent the conveyor belt 33 from idling upon rotation of the drive rollers 34, thereby preventing the conveying device 30 from malfunctioning.

It is preferable that the drive rollers 34 is composed of at least the upper drive roller 34*a* and the lower drive roller 34*b*, the upper drive roller 34*a* is disposed at an upper portion of the inside of the conveying device 30, the lower drive roller 34*b* is disposed at a lower portion of the inside of the conveying device 30, and the direction of water to be ejected by the water ejection device 70 extends toward the upper drive roller 34*a*. If the ejection direction of water from the water ejection device 70 is thus set, water ejected from the water ejection device 70 comes into contact with the upper drive roller 34*a* and the water is diffused. As a result, convection becomes likely to be caused for water in the water tank 20, whereby the cooling efficiency for the net structure 60 can be improved.

The distance between the lower drive roller 34*b* of the first conveyor 31 and the lower drive roller 34*b* of the second conveyor 32 is preferably shorter than the distance between the upper drive roller 34*a* of the first conveyor 31 and the upper drive roller 34*a* of the second conveyor 32. That is, it is preferable that the distance between the first conveyor 31 and the second conveyor 32 is shorter at lower portions thereof than at upper portions thereof and becomes shorter toward the lower portions. If the conveying device 30 is thus configured, the net structure 60 can be held between the lower portions of the conveying device 30. As a result, it becomes easy to lead the resin 12 as the filament and the net structure 60 into the water tank 20, and thus it becomes easy to cool the net structure 60.

The amount of water to be ejected by the water ejection device 70 preferably increases in accordance with increase in the amount of the resin extruded from the nozzle 10. That is, the volume ($m^3$/min) of water to be ejected by the water ejection device 70 and the extrusion amount (g/min) of the resin from the nozzle 10 are preferably associated with each other. If, for example, the amount of the resin 12 as the filament to be extruded from the nozzle 10 is increased for improving the resilience of the net structure 60, the temperature at a location near the water surface in the water tank 20 becomes more likely to be high, and thus the cooling efficiency for the net structure 60 deteriorates. In addition, the inside of the net structure 60 becomes less likely to be cooled, and unevenness in cooling becomes likely to occur in the thickness direction of the net structure 60. Therefore, if the ejection amount of water from the water ejection device 70 is increased in association with increase in the resin 12 as the filament extruded from the nozzle 10, convection of water in the water tank 20 is increased. Accordingly, it is possible to improve the cooling efficiency for the net structure 60, and prevent unevenness in cooling.

The volume ($m^3$/min) of water to be ejected by the water ejection device 70 is more preferably proportional to the extrusion amount (g/min) of the resin from the nozzle 10. If the volume of water to be ejected by the water ejection device 70 and the extrusion amount of the resin from the nozzle 10 are in such a relationship, the cooling efficiency for the net structure 60 can be further improved, and unevenness in cooling becomes less likely to occur.

It is also preferable that the amount of water to be ejected by the water ejection device 70 increases in accordance with increase in the speed of the conveying device 30. That is, the volume ($m^3$/min) of water to be ejected by the water ejection device 70 and the speed of conveying the net structure 60 by the conveying device 30 are preferably associated with each other. If the speed of the conveying device 30 is increased for the purpose of, for example, reducing the density of the net structure 60 in order to reduce the hardness of the net structure 60, transition to a next step occurs while the inside of the net structure 60 is left insufficiently cooled. If transition to a next step occurs in a state where the inside of the net structure 60 is left insufficiently cooled, a net structure 60 that, on the inside thereof, has a high repeated compression residual strain and has a low hardness retention rate after repeated compression and that is inferior in durability, might be obtained. Therefore, if the ejection amount of water from the water ejection device 70 is increased in association with increase in the speed of the conveying device 30, convection of water in the water tank 20 is increased. Accordingly, it is possible to improve the cooling efficiency for the net structure 60 at a location near the water surface, and sufficiently cool not only the surface portion but also the inside of the net structure 60.

The volume ($m^3$/min) of water to be ejected by the water ejection device 70 is more preferably proportional to the speed (m/min) of the conveying device 30. If the volume of water to be ejected by the water ejection device 70 and the speed of the conveying device 30 are in such a relationship, it is possible to further improve the cooling efficiency for the net structure 60, and prevent occurrence of unevenness in cooling.

It is more preferable that the amount of water to be ejected by the water ejection device 70 increases in accordance with increase in the amount of the resin extruded from the nozzle 10 and increases in accordance with increase in the speed of the conveying device 30. That is, the volume ($m^3$/min) of water to be ejected by the water ejection device 70 is more preferably proportional to the extrusion amount (g/min) of the resin from the nozzle 10 and the speed (m/min) of the conveying device 30. If the volume ($m^3$/min) of water to be ejected by the water ejection device 70 is thus set, even when, for example, the amount of the resin 12 as the filament to be extruded from the nozzle 10 is increased and the speed of the conveying device 30 is increased for the purpose of, for example, improving the productivity for the net structure 60, the resin 12 as the filaments can be sufficiently cooled by increasing the convection of water in the water tank 20. As a result, unevenness in cooling can be made less likely to occur in the thickness direction of the net structure 60.

The direction of water to be ejected by the water ejection device 70 is preferably associated with the amount of the resin extruded from the nozzle 10. If, for example, the amount of the resin 12 as the filament to be extruded from the nozzle 10 is increased for improving the resilience of the net structure 60, the temperature at a location near the water surface in the water tank 20 becomes more likely to be high, and thus the cooling efficiency for the net structure 60 deteriorates, and spots are more likely to be generated during cooling of the net structure 60. Therefore, if the ejection direction of water from the water ejection device 70 is set to approach the center of the resin 12 as the filament at the water surface in the water tank 20 in association with increase in the resin 12 as the filament extruded from the nozzle 10, convection is increased for water at a location near the water surface at which the temperature is likely to become high. Accordingly, the inside of the net structure 60 is sufficiently cooled, whereby unevenness in cooling can be prevented.

The direction of water to be ejected by the water ejection device 70 is preferably associated with the speed of the conveying device 30. If the speed of the conveying device 30 is increased for the purpose of, for example, reducing the density of the net structure 60 in order to reduce the hardness of the net structure 60, the inside of the net structure 60 is left insufficiently cooled, whereby the durability of the net structure 60 might decrease. Therefore, if the ejection direction of water from the water ejection device 70 is set to approach the center of the resin 12 as the filament at the water surface in the water tank 20 in association with increase in the speed of the conveying device 30, the cooling efficiency for the resin 12 as the filament is improved. Accordingly, the cooling efficiency for both the surface portion and the inside of the net structure 60 can be improved.

In addition, the direction of water to be ejected by the water ejection device 70 is more preferably associated with the amount of the resin extruded from the nozzle 10 and the speed of the conveying device 30. If the direction of water to be ejected by the water ejection device 70 is thus set, even when, for example, the amount of the resin 12 as the filament to be extruded from the nozzle 10 is increased and the speed of the conveying device 30 is increased for the purpose of, for example, improving the productivity for the net structure 60, great convection of water can be caused in the water tank 20 by setting the ejection direction of water from the water ejection device 70 to approach the center of the resin 12 as the filament at the water surface in the water tank 20. As a result, the cooling efficiency for the net structure 60 at a location near the water surface can be improved, and unevenness in cooling can be prevented from occurring on the net structure 60.

It is preferable that the water ejection device 70 has the water ejection hole 73 from which water is ejected, and that the position of the water ejection hole 73 from the water surface in the water tank 20 is associated with the amount of the resin extruded from the nozzle 10. That is, it is preferable that the position of the water ejection hole 73 of the water ejection device 70 can be shifted. Specifically, it is preferable that the position of the water ejection hole 73 from the water surface in the water tank 20 can be shifted in association with the amount of the resin extruded from the nozzle 10. If, for example, the amount of the resin 12 as the filament to be extruded from the nozzle 10 is increased for improving the resilience of the net structure 60, the temperature at a location near the water surface in the water tank 20 becomes more likely to be high, and thus the cooling efficiency for the net structure 60 deteriorates, and spots are more likely to be generated during cooling of the net structure 60. Therefore, if the distance D1 between the water ejection hole 73 and the water surface in the water tank 20 is shortened in association with increase in the resin 12 as the filament extruded from the nozzle 10, convection is caused for high-temperature water at a location near the water surface so that the water is moved. Accordingly, it is possible to improve the cooling efficiency for the net structure 60 at the location near the water surface, and prevent unevenness in cooling in the thickness direction of the net structure 60.

It is preferable that the water ejection device 70 has the water ejection hole 73 from which water is ejected, and that the position of the water ejection hole 73 from the water surface in the water tank 20 is associated with the speed of the conveying device 30. If the speed of the conveying device 30 is increased for the purpose of, for example, reducing the density of the net structure 60 in order to reduce the hardness of the net structure 60, the inside of the net structure 60 is left insufficiently cooled, whereby the durability of the net structure 60 might decrease. Therefore, if the distance D1 between the water ejection hole 73 and the water surface in the water tank 20 is shortened in association with increase in the speed of the conveying device 30, the surface portion and the inside of the net structure 60 can be sufficiently cooled. Accordingly, unevenness in cooling can be prevented from occurring on the net structure 60.

The position of the water ejection hole 73 of the water ejection device 70 from the water surface in the water tank 20 is more preferably associated with the amount of the resin extruded from the nozzle 10 and the speed of the conveying device 30. If the direction of water to be ejected by the water ejection device 70 is thus set, even when, for example, the amount of the resin 12 as the filament to be extruded from the nozzle 10 is increased and the speed of the conveying device 30 is increased for the purpose of, for example, improving the productivity for the net structure 60, the cooling efficiency for the net structure 60 can be improved and unevenness in cooling can be prevented from occurring on the net structure 60, by shortening the distance D1 between the water ejection hole 73 and the water surface in the water tank 20 so as to cause great convection of water in the water tank 20.

The net structure manufacturing apparatus 1 preferably includes a net structure drawing device 50 configured to draw the net structure 60 so as to pull it up from the water tank 20. If the net structure manufacturing apparatus 1 includes the net structure drawing device 50, after the net structure 60 is cooled, the net structure 60 can be automatically pulled up from the water tank 20 and transition to a drying step for the net structure 60 can be performed, whereby the productivity for the net structure 60 can be increased.

It is preferable that the net structure drawing device 50 configured to draw the net structure 60 is disposed on one side of the water tank 20, the conveying device 30 is composed of at least the first conveyor 31 and the second conveyor 32, and the water ejection device 70 is located on the net structure drawing device 50 side relative to the vertical plane p1 that includes the midpoint P1 between the first conveyor 31 and the second conveyor 32. In the water tank 20, the net structure 60 is present on the net structure drawing device 50 side relative to the vertical plane p1. Thus, in terms of efficient cooling of the net structure 60, convection of water is preferably caused to a greater extent on the net structure drawing device 50 side relative to the vertical plane p1 than on the side that is opposite, across the vertical plane p1, to the net structure drawing device 50 side. Therefore, if the water ejection device 70 is thus disposed, convection can be more efficiently caused for water near the net structure 60, whereby the cooling efficiency for the net structure 60 can be improved.

It is preferable that the water ejection device 70 is composed of at least a first water ejector 71 and a second water ejector 72, the conveying device 30 is composed of at least the first conveyor 31 and the second conveyor 32, the first water ejector 71 is disposed inside the first conveyor 31, and the second water ejector 72 is disposed inside the second conveyor 32. If the first water ejector 71 and the second water ejector 72 are thus disposed, convection of water can be caused on both sides of the net structure 60. Therefore, not only water near the net structure 60 but also the water in the entire water tank 20 can be moved, whereby the cooling efficiency for the net structure 60 can be further improved.

The ejection direction of water from the first water ejector 71 may be the same as or different from the ejection direction of water from the second water ejector 72. If, for example, the ejection direction of water from the first water ejector 71 is the vertical direction toward the water surface and the ejection direction of water from the second water ejector 72 is also the vertical direction toward the water surface, convection of water can be caused evenly on both sides of the resin 12 as the filament in the water tank 20, whereby convection can be caused so as to be balanced between the first water ejector 71 and the second water ejector 72.

Meanwhile, if the ejection direction of water from the first water ejector 71 and the ejection direction of water from the second water ejector 72 are different from each other, the first water ejector 71 and the second water ejector 72 can cause convection of water at respective different locations, and thus can preferentially cause convection at respective locations at which convection is desired to be caused.

The distance D1 between the water ejection hole 73 of the first water ejector 71 and the water surface in the water tank 20 may be equal to or different from the distance between the water ejection hole 73 of the second water ejector 72 and the water surface in the water tank 20. If the distance D1 between the water ejection hole 73 of the first water ejector 71 and the water surface in the water tank 20 is equal to the distance between the water ejection hole 73 of the second water ejector 72 and the water surface in the water tank 20, the extent of convection to be caused by the first water ejector 71 and the extent of convection to be caused by the second water ejector 72 can be set to be the same as each other. Therefore, convection can be caused in the water tank 20 so as to be balanced between the first water ejector 71 and the second water ejector 72.

Meanwhile, if the distance D1 between the water ejection hole 73 of the first water ejector 71 and the water surface in the water tank 20 is different from the distance between the water ejection hole 73 of the second water ejector 72 and the water surface in the water tank 20, specifically, if the distance D1 between the water ejection hole 73 of the first water ejector 71 and the water surface in the water tank 20 is longer than the distance between the water ejection hole 73 of the second water ejector 72 and the water surface in the water tank 20 with the first water ejector 71 being disposed on a side where the net structure drawing device 50 is disposed, the first water ejector 71 is located closer to the net structure 60. Accordingly, convection can be caused more greatly at a location near the net structure 60. Therefore, the cooling efficiency for the net structure 60 can be improved.

The amount of water to be ejected by the first water ejector 71 may be equal to or different from the amount of water to be ejected by the second water ejector 72. If the amount of water to be ejected by the first water ejector 71 is equal to the amount of water to be ejected by the second water ejector 72, convection can be caused for water in the water tank 20 such that the extent of the convection becomes the same between the first water ejector 71 and the second water ejector 72, whereby convection can be caused in a balanced manner in the water tank 20.

Meanwhile, if the amount of water to be ejected by the first water ejector 71 is different from the amount of water to be ejected by the second water ejector 72, specifically, if the amount of water to be ejected by the first water ejector 71 is larger than the amount of water to be ejected by the second water ejector 72 with the first water ejector 71 being disposed on a side where the net structure drawing device 50 is disposed, convection of water caused by the first water ejector 71 closer to the net structure 60 can be set to be greater, whereby the net structure 60 can be efficiently cooled.

The water in the water tank 20 may be discharged, and low-temperature water may be newly supplied into the water tank 20. Although not shown in figure, the discharge of the water from the water tank 20 may be performed by so-called overflow in which the water is discharged from a tube or the like disposed at an upper portion of the water tank 20. Specific examples of such discharge include discharge in which low-temperature water is newly supplied into the water tank 20 from a lower portion of the water tank 20 and water that has an increased temperature is caused to overflow.

A second net structure manufacturing method according to the present invention includes the steps of; causing melted thermoplastic resin to be extruded so as to be formed as a filament; conveying, in a water tank, a net structure having a resin as the filament by a first conveyor and a second conveyor; and ejecting, by a water ejection device, water in a direction that does not extend toward the net structure located between the first conveyor and the second conveyor.

A thermoplastic resin which is a material for a net structure is heated and melted, and the resin is extruded so as to be formed as a filament. For forming the resin as a filament, extrusion of melted thermoplastic resin from a nozzle or the like having a discharge hole, or the like, may be performed.

The extruded resin as the filament is received in a water tank storing water therein. The resin as the filament comes down on the water surface in the water tank and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure is formed.

The net structure is conveyed inside the water tank by a first conveyor and a second conveyor. The conveyance means preferably convey the net structure downward from the water surface in the water tank. If the net structure is thus conveyed by the conveyance means, the extruded resin as the filament is continuously formed as a sheet-like net structure. Thus, a net structure having such a size as to be suitable as a cushion material for beddings and seats can be manufactured. As the conveyance means, for example, a conveying device such as any of the aforementioned conveyors can be used.

Water is ejected into the water in the water tank by the water ejection device. The ejection direction of water from the water ejection device is set to be a direction that does not extend toward the net structure located between the first conveyor and the second conveyor. By thus ejecting water in the water, convection is caused for water in the water tank, water that is present at a location near the water surface and that has an increased temperature is moved, and low-temperature water is supplied. Accordingly, the net structure is efficiently cooled, whereby not only the surface portion but also the inside of the resin as the filament can be sufficiently cooled. Therefore, a net structure in which unevenness in cooling is less likely to occur and which has high durability, can be manufactured.

The net structure after the cooling is pulled up from the water tank and dried, whereby a net structure can be manufactured. It is preferable to perform, before and after drying the net structure, pseudo-crystallization in which heating is performed for a certain time at a temperature lower than the melting point of the resin used as the material of the net structure. If pseudo-crystallization is performed on the net structure, the durability of the net structure can be improved. It is considered that, in pseudo-crystallization, hard segments of the resin are rearranged by the heating, a metastable intermediate phase is formed, and pseudocrystal-like crosslinking points are formed, whereby the durabilities of the net structure such as heat resistance and sag resistance are improved.

As described above, the second net structure manufacturing apparatus according to the present invention includes; the nozzle having the discharge hole from which melted thermoplastic resin is extruded so as to be formed as a filament; the water tank disposed below the nozzle; the conveying device provided to the water tank and configured to convey a net structure having a resin as the filament; and the water ejection device provided to the water tank and configured to eject water in a predetermined direction. The conveying device is composed of at least the first conveyor and the second conveyor. The net structure is located between the first conveyor and the second conveyor. The net structure located between the conveyors is not present on the extension line of the ejection direction of water from the water ejection device. With this configuration, convection is caused for water in the water tank, whereby it becomes easy to evenly cool the surface portion and the inside of the net structure. Therefore, it is possible to provide a manufacturing apparatus for manufacturing a net structure in which unevenness in cooling is less likely to occur in the thickness direction of the net structure and which has sufficient durability.

A third net structure manufacturing apparatus according to the present invention will be described below.

The third net structure manufacturing apparatus according to the present invention includes: a nozzle having a discharge hole from which melted thermoplastic resin is extruded so as to be formed as a filament; a water tank disposed below the nozzle; a conveying device provided to the water tank and configured to convey a net structure having a resin as the filament; and a water discharge port provided in a bottom portion of the water tank.

A net structure of the present invention is a structure having a three-dimensional random loop-bonded configuration, in which a resin as a filament which is a thermoplastic resin is curled to form random loops and the loops in a melted state are brought into contact with and bonded to one another.

FIGS. 4 to 6 are a side view of the first net structure manufacturing apparatus according to an embodiment of the present invention. A net structure manufacturing apparatus 1 includes a nozzle 10, a water tank 20, a conveying device 30, and a water discharge port 80.

The nozzle 10 has a discharge hole 11 from which melted thermoplastic resin is extruded so as to be formed as a filament. Specifically, a thermoplastic resin melted by being heated is extruded from the discharge hole 11 of the nozzle 10, whereby a resin 12 as the filament is formed.

The number of discharge holes 11 of the nozzle 10 may be one or may be two or more. In a case where the nozzle 10 has a plurality of the discharge holes 11, the plurality of the discharge holes 11 may be arranged in one row, but are preferably arranged in a plurality of rows. If the nozzle 10 has the plurality of the discharge holes 11, a plurality of resins 12 as filaments can be formed at the same time, whereby production efficiency for the net structure 60 can be improved. The number of discharge holes 11 of the nozzle 10 can be adjusted according to the hardness and the cushioning performance of the net structure 60 to be manufactured.

The cross-sectional shape of an outlet of the discharge hole 11 is not particularly limited, and examples of the cross-sectional shape include the shapes of a circle, an ellipse, and a polygon. Among these shapes, the cross-sectional shape of the outlet of the discharge hole 11 is preferably the shape of a circle or an ellipse. If the discharge hole 11 is thus configured, a cross-sectional shape of the resin 12 as the filament extruded from the discharge hole 11 is also the shape of the circle or the ellipse. Therefore, when the aforementioned three-dimensional random loop-bonded configuration is formed, the area in which the resins 12 as the filaments come into contact with one another is increased, and a net structure 60 having high elasticity and durability can be manufactured.

The cross-sectional shape of the resin 12 as the filament extruded from the discharge hole 11 may be a solid shape or a hollow shape. For causing the cross-sectional shape of the resin 12 as the filament to be a hollow shape, for example, a nozzle in which a core portion such as a core rod is provided inside the discharge hole 11 may be used. Specific examples of the nozzle include: a so-called C-type nozzle in which the outlet of a discharge hole 11 has a cross-sectional shape in which the inner side and the outer side of the discharge hole 11 are in partial communication with each other; and a so-called three-point bridge-shaped nozzle in which a bridge is provided to the discharge hole 11 so as to divide the discharge hole 11 in the circumferential direction.

The length in the longitudinal direction of the cross-sectional shape of the outlet of the discharge hole 11 is preferably not smaller than 0.1 mm, more preferably not smaller than 0.5 mm, and further preferably not smaller than 1.0 mm. If the lower limit value for the length in the longitudinal direction of the cross-sectional shape of the outlet of the discharge hole 11 is thus set, the durability of the net structure 60 is improved, and the net structure 60 can be made capable of enduring repetitive compression. Meanwhile, the length in the longitudinal direction of the cross-sectional shape of the outlet of the discharge hole 11 is preferably not larger than 10 mm, more preferably not larger than 7 mm, and further preferably not larger than 5 mm. If the upper limit value for the length in the longitudinal direction of the cross-sectional shape of the outlet of the discharge hole 11 is thus set, a net structure 60 having favorable cushioning performance can be manufactured.

In the case where the nozzle 10 has a plurality of the discharge holes 11, the sizes of the cross-sectional shapes of the outlets of the discharge holes 11 may be the same as or different from one another. If the sizes of the cross-sectional shapes of the outlets of all the discharge holes 11 of the nozzle 10 are set to be the same as one another, a net structure 60 in which the resins 12 as the filaments have equal thicknesses can be obtained. Meanwhile if, for example, the size of the cross-sectional shape of the outlet of the discharge hole 11 at the center of the nozzle 10 is set to be smaller than the sizes of the cross-sectional shapes of the outlets of the discharge holes 11 surrounding the discharge hole 11, the resin 12 as the filament inside the net structure 60 becomes thinner than the resins 12 as the filaments at the surface portion of the net structure 60, and thus the temperature of the net structure 60 becomes more likely to decrease on the inside thereof than on the surface portion thereof. Therefore, a net structure 60 having a configuration in which unevenness in cooling is less likely to occur, can be manufactured.

Examples of the thermoplastic resin to be extruded from the discharge hole 11 include a polyester-based thermoplastic elastomer, a polyolefin-based thermoplastic elastomer, a polystyrene-based thermoplastic elastomer, a polyurethane-based thermoplastic elastomer, a polyamide-based thermoplastic elastomer, and an ethylene-vinyl acetate copolymer. The thermoplastic resin preferably contains, among these thermoplastic resins, at least any of a polyester-based thermoplastic elastomer, a polyolefin-based thermoplastic elastomer, and a polystyrene-based thermoplastic elastomer. If the thermoplastic resin contains at least any of a polyester-based thermoplastic elastomer, a polyolefin-based thermoplastic elastomer, and a polystyrene-based thermoplastic elastomer, processability is improved, and the net structure 60 becomes easy to manufacture. The thermoplastic resin more preferably contains a polyester-based thermoplastic elastomer. If the thermoplastic resin contains a polyester-based thermoplastic elastomer, repeated compression residual strain can be made low. In addition, if the thermoplastic resin contains a polyester-based thermoplastic elastomer, the hardness retention rate of the net structure 60 after repeated compression can be made high, and a net structure 60 having high durability can be manufactured.

The water tank 20 is disposed below the nozzle 10 and configured to be able to receive the resin 12 as the filament extruded from the discharge hole 11 of the nozzle 10. The water tank 20 contains water for cooling the resin 12 as the filament extruded from the discharge hole 11 of the nozzle 10. The resin 12 as the filament extruded from the discharge hole 11 of the nozzle 10 comes down on the water surface in the water tank 20 and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure 60 is obtained.

The conveying device 30 is provided to the water tank 20, and conveys the net structure 60 having the resin 12 as the filament. That is, the conveying device 30 conveys, in the water tank 20, the net structure 60 having the resin 12 as the filament extruded from the discharge hole 11 of the nozzle 10 and received in the water tank 20. The conveying device 30 preferably conveys the net structure 60 from the water surface in the water tank 20 toward a bottom portion of the water tank 20. The conveying device 30 is preferably provided in the water tank 20.

The type of the conveying device 30 is not particularly limited, and examples thereof include conveyors such as a belt conveyor, a net conveyor, and a slat conveyor. The details of the conveying device 30 will be described later.

The water discharge port 80 is provided in the bottom portion of the water tank 20, and water in the water tank 20 is discharged from the water discharge port 80. Since the water discharge port 80 from which water is discharged is provided in the bottom portion of the water tank 20, water at a location at which the temperature is likely to become high and which is near the net structure 60 in the water tank 20, particularly, on the inside of the net structure 60, is discharged. By discharging water that has an increased temperature in the water tank 20, the temperature of the water in the entire water tank 20 is prevented from increasing. In addition, by discharging water on the inside of the net structure 60 where unevenness in cooling is likely to occur, a great difference in temperature is less likely to be generated between the surface portion and the inside of the net structure 60. Accordingly, both the surface portion and the inside of the net structure 60 can be cooled evenly, whereby unevenness in cooling is less likely to occur. Since unevenness in cooling is less likely to occur, it is possible to prevent, during manufacturing of the net structure 60, increase in the repeated compression residual strain and decrease in the hardness retention rate after repeated compression due to insufficient cooling. Accordingly, a net structure 60 having high durability can be manufactured.

It is preferable that, after water in the water tank 20 is discharged from the water discharge port 80 in the bottom portion of the water tank 20, water having a lower temperature than the temperature of the discharged water is newly supplied. Although not shown in figure, low-temperature water may be supplied by, for example, disposing a water supply tube or the like in the water tank 20 and supplying low-temperature water through the water supply tube into the water tank. If the net structure manufacturing apparatus 1 is thus configured, it is possible to prevent increase in the temperature of the water in the entire water tank 20 since low-temperature water is supplied after water that has an increased temperature in the water tank 20 is discharged. In addition, since water is newly supplied into the water tank 20 after water discharge, the water level in the water tank 20 can be prevented from excessively decreasing.

It is preferable that, in the water tank 20, a barrier board 81 is provided on a periphery of the water discharge port 80. If the water discharge port 80 has the barrier board 81 on the periphery thereof on the inner surface of the water tank 20, water located vertically above the water discharge port 80 can be preferentially discharged, whereby adjustment regarding water discharge can be performed.

The barrier board 81 may be provided on a part of the periphery of the water discharge port 80, but is preferably provided over the entire periphery. If the barrier board 81 is provided over the entire periphery of the water discharge port 80, it becomes easier to perform adjustment regarding discharge of the water in the water tank 20 from the water discharge port 80.

Examples of the shape of the water discharge port 80 as seen in a direction perpendicular to the water surface in the water tank 20 include the shapes of a circle, an ellipse, and a polygon. Among these shapes, the shape of the water discharge port 80 is preferably the shape of a rectangle. If the shape of the water discharge port 80 is the shape of a rectangle, water at a location near the resin 12 as the filament can be efficiently discharged, and water having a lower temperature than the discharged water is supplied to the location near the resin 12 as the filament. Accordingly, it becomes easy to evenly cool the surface portion and the inside of the resin 12 as the filament.

Although not shown in figure, it is preferable that the net structure manufacturing apparatus 1 includes a heat exchanger configured to cool water that has been discharged from the water discharge port 80, and the water is circulated. If the net structure manufacturing apparatus 1 is thus configured, the amount of water to be disposed of during manufacturing of the net structure 60 can be reduced by reusing discharged water, whereby water resources can be conserved.

The upper end of the conveying device 30 is preferably located above the water surface in the water tank 20. If the conveying device 30 is thus disposed, when the resin 12 as the filament extruded from the discharge hole 11 of the nozzle 10 comes into contact with the water in the water tank 20, the resin 12 as the filament can be prevented from freely moving on the water surface, and the thickness of the net structure 60 can be prevented from excessively increasing.

The conveying device 30 preferably includes the conveyor belt 33 and the drive roller 34. Examples of the conveyor belt 33 include: a flat belt made of rubber or resin; a net conveyor belt obtained by continuously knitting or weaving metallic wires so as to have a mesh pattern; and a slat conveyor belt in which metallic slats are continuously attached to conveyor chains.

Among these conveyor belts, the conveyor belt 33 is preferably a net conveyor belt because of favorable holding performance thereof and excellent water permeability thereof. That is, the conveying device 30 is, as the conveying device, preferably a net conveyor having a mesh-pattern belt and a drive roller. If the conveying device 30 is thus configured, water can pass through the conveying device 30. Accordingly, convection of water in the water tank 20 caused by the water ejection device 70 is less likely to be hindered by the conveying device 30, whereby the cooling efficiency for the net structure 60 can be improved.

The conveyor belt 33 is preferably endless. If the conveyor belt 33 is formed so as to be endless, the endless conveyor belt 33 is rotated in an uninterrupted manner by rotation of the drive roller 34, whereby the conveying device 30 can be continuously operated. As a result, the net structure 60 can be efficiently conveyed.

It is preferable that the number of drive rollers 34 is two or more and the drive rollers 34 are disposed at an upper portion and a lower portion of the inside of the endless conveyor belt 33. That is, it is preferable that an upper drive roller **34*a* is disposed at an upper portion of the inside of the conveyor belt 33 and a lower drive roller 34*b* is disposed at a lower portion of the inside of the conveyor belt 33. If the drive rollers 34 are thus configured, the conveyor belt 33 becomes less likely to be distorted, and it is possible to prevent the conveyor belt 33 from idling upon rotation of the drive rollers 34, thereby preventing the conveying device 30** from malfunctioning.

It is preferable that the conveying device 30 is composed of at least the first conveyor 31 and the second conveyor 32, and the net structure 60 is located between the first conveyor 31 and the second conveyor 32. If the conveying device 30 is thus configured, the net structure 60 can be conveyed in a state of being held between the first conveyor 31 and the second conveyor 32. Accordingly, a net structure 60 having a smooth surface and having a uniform thickness can be obtained.

The distance between the lower drive roller 34*b* of the first conveyor 31 and the lower drive roller 34*b* of the second conveyor 32 is preferably shorter than the distance between the upper drive roller 34*a* of the first conveyor 31 and the upper drive roller 34*a* of the second conveyor 32. That is, it is preferable that the distance between the first conveyor 31 and the second conveyor 32 is shorter at lower portions thereof than at upper portions thereof and becomes shorter toward the lower portions. If the conveying device 30 is thus configured, the net structure 60 can be held between the lower portions of the conveying device 30. As a result, it becomes easy to lead the resin 12 as the filament and the net structure 60 into the water tank 20, and thus it becomes easy to cool the net structure 60.

It is preferable that, as shown in FIG. 1, the conveying device 30 is composed of at least the first conveyor 31 and the second conveyor 32, and the water discharge port 40 is provided at a position that includes an intersection P2 between the bottom of the water tank 20 and a perpendicular line L1 extended downward to the bottom of the water tank 20 from the midpoint P1 between the first conveyor 31 and the second conveyor 32. The temperature of water at a location near the water surface at which the resin 12 as the filament extruded from the discharge hole 11 of the nozzle 10 comes into contact with the water in the water tank 20, becomes highest, and the temperature of water vertically below the water surface at which the extruded resin 12 as the filament comes into contact with the water, also tends to be high. Therefore, if the water discharge port 40 is provided at such a location, it is possible to preferentially discharge: water at the location near the water surface at which the temperature becomes high and at which the extruded resin 12 as the filament comes into contact with the water; and water vertically below this location. Accordingly, the resin 12 as the filament and the net structure 60 can be efficiently cooled.

The net structure manufacturing apparatus 1 preferably includes a net structure drawing device 50 configured to draw the net structure 60 so as to pull it up from the water tank 20. If the net structure manufacturing apparatus 1 includes the net structure drawing device 50, after the net structure 60 is cooled, the net structure 60 can be automatically pulled up from the water tank 20 and transition to a drying step for the net structure 60 can be performed, whereby the productivity for the net structure 60 can be increased.

It is also preferable that, as shown in FIG. 2, the net structure drawing device 50 configured to draw the net structure 60 is disposed on one side of the water tank 20, the conveying device 30 is composed of at least the first conveyor 31 and the second conveyor 32, the first conveyor 31 is located on the net structure drawing device 50 side relative to the second conveyor 32, and the water discharge port 80 is located on the net structure drawing device 50 side relative to the first conveyor 31. The phrase "the water discharge port 80 is located on the net structure drawing device 50 side relative to the first conveyor 31" refers to a state where an end of the water discharge port 80 on the side opposite to the net structure drawing device 50 side is located on the net structure drawing device 50 side relative to an end of the first conveyor 31 on the side opposite to the net structure drawing device 50 side. The net structure 60 is drawn by the net structure drawing device 50, and water having cooled the net structure 60 and thus having an increased temperature tends to also move, together with the net structure 60, to the one side of the water tank 20 where the net structure drawing device 50 is disposed. Therefore, if the water discharge port 80 is provided at such a location, water that has an increased temperature in the water tank 20 can be efficiently discharged. Accordingly, the cooling efficiency for the net structure 60 can be improved.

It is also preferable that, as shown in FIG. 3, the net structure drawing device 50 configured to draw the resin 12 as the filament is disposed on the one side of the water tank 20, the conveying device 30 is composed of at least the first conveyor 31 and the second conveyor 32, the first conveyor 31 is located on the net structure drawing device 50 side relative to the second conveyor 32, and the water discharge port 80 is located on the side that is opposite, across the second conveyor 32, to the net structure drawing device 50 side. The phrase "the water discharge port 80 is located on the side that is opposite, across the second conveyor 32, to the net structure drawing device 50 side" refers to a state where an end of the water discharge port 80 on the net structure drawing device 50 side is located on the side that is opposite, across an end of the second conveyor 32 on the net structure drawing device 50 side, to the net structure drawing device 50 side. Depending on the material, the diameter, the density, or the like of the resin 12 as the filament, flow of water caused by water discharge from the water discharge port 80 may deform or damage the net structure 60, or may inflict another adverse effect. Therefore, if the water discharge port 80 is provided at such a location, water that has an increased temperature in the water tank 20 is discharged and the net structure 60 can be efficiently cooled, while influence on the net structure 60 is mitigated.

The number of water discharge ports 80 may be one or may be two or more. If the number of water discharge ports 80 is one, water vertically above the location at which the water discharge port 80 is provided can be preferentially discharged. Meanwhile, if the number of water discharge ports 80 is two or more, water can be discharged at a plurality of locations in the water tank 20. Thus, in cases where the temperature of the water in the water tank 20 is likely to increase such as a case where the capacity of the water tank 20 is small, high-temperature water in the water tank 20 and newly supplied low-temperature water can be quickly exchanged.

If, in FIG. 4 to FIG. 6, the front-face side of each drawing sheet surface is defined as a near side and the back-face side of the drawing sheet surface is defined as a far side, the length between the near-side end and the far-side end of the water discharge port 80 is preferably larger than the length between the near-side end and the far-side end of the conveying device 30. If the size of the water discharge port 80 is thus set, water that is on the inside of the net structure 60 in the water tank 20 and that has an increased temperature can be sufficiently discharged. Accordingly, the temperature of the water in the entire water tank 20 can be prevented from increasing, whereby the cooling efficiency for the net structure 60 can be improved.

If, in FIG. 4 to FIG. 6, the side on which the first conveyor 31 is disposed is defined as one side and the side opposite thereto, i.e., the side on which the second conveyor 32 is disposed, is defined as the other side, the length between the one-side end and the other-side end of the water discharge port 80 is preferably larger than the length between the first conveyor 31 and the second conveyor 32. When the net structure 60 comes into contact with the conveying device 30, the temperature of a part of the conveying device 30 with which the net structure 60 has come into contact increases, so that the temperature of water near the part of the conveying device 30 also increases. That is, heat from the net structure 60 is conveyed via the conveying device 30 to water that is not in direct contact with the net structure 60. If the size of the water discharge port 40 is thus set, it is possible to discharge not only water on the inside of the net structure 60 in the water tank 20 but also water that has an increased temperature owing to contact with the net structure 60 and that is near the part of the conveying device 30. Therefore, the temperature of the water in the entire water tank 20 is prevented from increasing, whereby the net structure 60 can be efficiently cooled.

The net structure manufacturing apparatus 1 preferably includes water discharge amount adjusting means 82 configured to adjust the amount of water discharge from the water discharge port 80. If the net structure manufacturing apparatus 1 includes the water discharge amount adjusting means 82, the amount of water discharged from the water discharge port 80 and the amount of water supplied to the water tank 20 can be balanced with each other. Specifically, if, for example, the amount of water discharged from the water discharge port 80 is excessively larger than the amount of water supplied to the water tank 20, the water discharge amount adjusting means 82 reduces the amount of water discharge, thereby preventing excessive decrease in the water level in the water tank 20. Meanwhile, if, for example, the amount of water discharged from the water discharge port 80 is excessively smaller than the amount of water supplied to the water tank 20, the water discharge amount adjusting means 82 increases the amount of water discharge, thereby preventing water from spilling over the water tank 20. As the water discharge amount adjusting means 82, for example, a valve, a slidable opening/closing lid, a pump, or the like can be used.

The water discharge amount adjusting means 82 preferably increases the amount of water discharge from the water discharge port 80 in accordance with increase in the amount of the resin extruded from the nozzle 10. That is, the amount ($m^3$/min) of water discharge from the water discharge port 80 to be adjusted by the water discharge amount adjusting means 82 and the extrusion amount (g/min) of the resin from the nozzle 10 are preferably associated with each other. If, for example, the amount of the resin 12 as the filament to be extruded from the nozzle 10 is increased for improving the resilience of the net structure 60, the temperature at a location near the water surface in the water tank 20 becomes more likely to be high, and thus the cooling efficiency for the net structure 60 deteriorates. In addition, if the amount of the resin 12 as the filament to be extruded from the nozzle 10 is increased, the inside of the net structure 60 becomes less likely to be cooled, and unevenness in cooling becomes more likely to occur in the thickness direction of the net structure 60. Therefore, if the amount of water discharge from the water discharge port 80 is increased in association with increase in the resin 12 as the filament extruded from the nozzle 10, water that has an increased temperature is quickly discharged from the water tank 20 so that the temperature of the water in the entire water tank 20 is prevented from increasing. Accordingly, it is possible to improve the cooling efficiency for the net structure 60, and prevent unevenness in cooling.

The amount ($m^3$/min) of water discharge from the water discharge port 80 to be adjusted by the water discharge amount adjusting means 82 is more preferably proportional to the extrusion amount (g/min) of the resin from the nozzle 10. If the amount of water discharge from the water discharge port 80 and the extrusion amount of the resin from the nozzle 10 are in such a relationship, it is possible to further improve the cooling efficiency for the net structure 60, and unevenness in cooling becomes less likely to occur.

It is also preferable that the water discharge amount adjusting means 82 increases the amount of water discharge from the water discharge port 80 in accordance with increase in the speed of the conveying device 30. That is, the amount ($m^3$/min) of water discharge from the water discharge port 80 to be adjusted by the water discharge amount adjusting means 82, and the speed of conveying the net structure 60 by the conveying device 30, are preferably associated with each other. If the speed of the conveying device 30 is increased for the purpose of, for example, reducing the density of the net structure 60 in order to reduce the hardness of the net structure 60, transition to a next step occurs while the inside of the net structure 60 is left insufficiently cooled. If transition to a next step occurs in a state where the inside of the net structure 60 is left insufficiently cooled, a net structure 60 that, on the inside thereof, has a high repeated compression residual strain and has a low hardness retention rate after repeated compression and that is inferior in durability, might be obtained. Therefore, if the amount of water discharge from the water discharge port 80 is increased in association with increase in the speed of the conveying device 30, water that has an increased temperature in the water tank 20 is quickly discharged from the water tank 20 so that the temperature of the water in the entire water tank 20 can be prevented from increasing. Accordingly, it is possible to improve the cooling efficiency for the net structure 60, and sufficiently cool not only the surface portion but also the inside of the net structure 60.

The amount ($m^3$/min) of water discharge from the water discharge port 80 to be adjusted by the water discharge amount adjusting means 82 is more preferably proportional to the speed (m/min) of the conveying device 30. If the amount of water discharge from the water discharge port 80 and the speed of the conveying device 30 are in such a relationship, it is possible to further improve the cooling efficiency for the net structure 60, and prevent occurrence of unevenness in cooling.

In addition, it is more preferable that the amount of water discharge from the water discharge port 80 to be adjusted by the water discharge amount adjusting means 82 increases in accordance with increase in the amount of the resin extruded from the nozzle 10, and increases in accordance with increase in the speed of the conveying device 30. That is, the amount ($m^3$/min) of water discharge from the water discharge port 80 is more preferably proportional to the extrusion amount (g/min) of the resin from the nozzle 10 and the speed (m/min) of the conveying device 30. If the amount ($m^3$/min) of water discharge from the water discharge port 80 is thus set, even when, for example, the amount of the resin 12 as the filament to be extruded from the nozzle 10 is increased and the speed of the conveying device 30 is increased for the purpose of, for example, improving the productivity for the net structure 60, the temperature of the water in the entire water tank 20 can be prevented from increasing, by increasing the discharge speed of water that has an increased temperature in the water tank 20. Therefore, the net structure 60 can be sufficiently cooled, and unevenness in cooling in the thickness direction of the net structure 60 can be made less likely to occur.

Water discharge means other than the water discharge port 80 provided in the bottom portion of the water tank 20 may be provided. Although not shown in figure, examples of the water discharge means other than the water discharge port 80 include so-called overflow in which water is discharged from a tube or the like disposed at an upper portion of the water tank 20.

A third net structure manufacturing method according to the present invention includes the steps of causing melted thermoplastic resin to be extruded so as to be formed as a filament; conveying, in a water tank, a net structure having a resin as the filament by conveyance means; discharging water in the water tank from a water discharge port provided in a bottom portion of the water tank; and supplying, into the water tank, water that has a lower temperature than the water discharged from the water discharge port.

A thermoplastic resin which is a material for a net structure is heated and melted, and the resin is extruded so as to be formed as a filament. For forming the resin as a filament, extrusion of melted thermoplastic resin from a nozzle or the like having a discharge hole, or the like, may be performed.

The extruded resin as the filament is received in a water tank storing water therein. The resin as the filament comes down on the water surface in the water tank and is curled to form a random loop. The random loop comes into contact with an adjacent random loop in a state where the random loops are melted together. Accordingly, a structure in which the random loops are bonded to each other in the three-dimensional directions is formed, and at the same time, the structure is cooled with water, to be fixed. In this manner, a net structure is formed.

The net structure is conveyed inside the water tank by conveyance means. The conveyance means preferably conveys the net structure downward from the water surface in the water tank. If the net structure is conveyed by such conveyance means, the extruded resin as the filament is continuously formed as a sheet-like net structure. Thus, a net structure having such a size as to be suitable as a cushion material for beddings and seats can be manufactured. As the conveyance means, for example, a conveying device such as any of the aforementioned conveyors can be used.

Water in the water tank is discharged from a water discharge port provided in a bottom portion of the water tank. Since water, in the water tank, of which the temperature is increased by the extruded resin as the filament is discharged from the water discharge port, the temperature of the water in the entire water tank is prevented from increasing, thereby preventing decrease in the cooling efficiency for the net structure.

Water that has a lower temperature than the water discharged from the water discharge port is supplied into the water tank. When the low-temperature water is supplied into the water tank, the temperature of the water in the entire water tank is reduced. Accordingly, the net structure is efficiently cooled, whereby not only the surface portion but also the inside of the net structure can be sufficiently cooled. Therefore, a net structure in which unevenness in cooling is less likely to occur and which has high durability, can be manufactured.

It is preferable that the water discharged from the water discharge port is cooled by the heat exchanger, to be supplied into the water tank and circulated. If the temperature of the water discharged from the water discharge port is reduced and the discharged water is circulated and reused, the amount of water to be disposed of during manufacturing of the net structure can be reduced, whereby water resources can be conserved.

The net structure after the cooling is pulled up from the water tank and dried, whereby a net structure can be manufactured. It is preferable to perform, before and after drying the net structure, pseudo-crystallization in which heating is performed for a certain time at a temperature lower than the melting point of the resin used as the material of the net structure. If pseudo-crystallization is performed on the net structure, the durability of the net structure can be improved. It is considered that, in pseudo-crystallization, hard segments of the resin are rearranged by the heating, a metastable intermediate phase is formed, and pseudocrystal-like crosslinking points are formed, whereby the durabilities of the net structure such as heat resistance and sag resistance are improved.

As described above, the third net structure manufacturing apparatus according to the present invention includes: the nozzle having the discharge hole from which melted thermoplastic resin is extruded so as to be formed as a filament; the water tank disposed below the nozzle; the conveying device provided to the water tank and configured to convey a net structure having a resin as the filament; and the water discharge port provided in the bottom portion of the water tank. Since the third net structure manufacturing apparatus has this configuration, water that has an increased temperature and that is near the net structure in the water tank, particularly, on the inside of the net structure, is discharged from the water discharge port provided in the bottom portion of the water tank, whereby it is possible to prevent increase in the temperature of the water in the entire water tank. As a result, it becomes easy to evenly cool the surface portion and the inside of the net structure. Therefore, a net structure in which unevenness in cooling is less likely to occur in the thickness direction of the net structure and which has sufficient durability, can be manufactured.

The present application claims the benefit of priority based on JP-A-2018-063111, JP-A-2018-063112, and JP-A-2018-063113 filed on Mar. 28, 2018. The entire content of the specification of JP-A-2018-063111, JP-A-2018-063112, and JP-A-2018-063113 filed on Mar. 28, 2018 is incorporated herein by reference.

DESCRIPTION OF REFERENCE SIGNS

1 net structure manufacturing apparatus
10 nozzle
11 discharge hole
12 resin as filament
20 water tank
30 conveying device
31 first conveyor
32 second conveyor
33 conveyor belt
34 drive roller
**34*a*** upper drive roller
**34*b*** lower drive roller
40 gas ejection device
41 first gas ejector
42 second gas ejector
43 gas ejection hole
50 net structure drawing device
60 net structure
70 water ejection device
71 first water ejector
72 second water ejector

73 water ejection hole
80 water discharge port
81 barrier board
82 water discharge amount adjusting means
P1 midpoint between first conveyor and second conveyor
L1 perpendicular line extended downward from midpoint P1 to bottom of water tank
P2 intersection between L1 and bottom of water tank
p1 vertical plane including midpoint P1
D1 distance between water ejection hole and water surface in water tank

The invention claimed is:

1. A net structure manufacturing apparatus comprising:
a nozzle having a discharge hole from which melted thermoplastic resin is extruded so as to be formed as a filament;
a water tank disposed below the nozzle;
a conveying device provided to the water tank and configured to convey a net structure having a resin as the filament; and
a gas ejection device provided to the water tank and configured to eject gas.

2. The net structure manufacturing apparatus according to claim 1, wherein the gas ejection device is disposed below the conveying device.

3. The net structure manufacturing apparatus according to claim 1, wherein
the gas ejection device has an ejection hole from which gas is ejected, and
a direction of a normal to the ejection hole extends toward a water surface in the water tank.

4. The net structure manufacturing apparatus according to claim 1, wherein
the conveying device is composed of at least a first conveyor and a second conveyor,
the net structure is located between the first conveyor and the second conveyor,
the gas ejection device has an ejection hole from which gas is ejected, and
a direction of a normal to the ejection hole extends toward the net structure located between the conveyors.

5. The net structure manufacturing apparatus according to claim 1, wherein an amount of gas to be ejected by the gas ejection device increases in accordance with increase in an amount of the resin extruded from the nozzle.

6. The net structure manufacturing apparatus according to claim 1, wherein an amount of gas to be ejected by the gas ejection device increases in accordance with increase in a speed of the conveying device.

7. A net structure manufacturing apparatus comprising:
a nozzle having a discharge hole from which melted thermoplastic resin is extruded so as to be formed as a filament;
a water tank disposed below the nozzle;
a conveying device provided to the water tank and configured to convey a net structure having a resin as the filament; and
a water ejection device provided to the water tank and configured to eject water in a predetermined direction, wherein
the conveying device is composed of at least a first conveyor and a second conveyor,
the net structure is located between the first conveyor and the second conveyor, and
the net structure located between the conveyors is not present on an extension line of an ejection direction of water from the water ejection device.

8. The net structure manufacturing apparatus according to claim 7, wherein the ejection direction of water from the water ejection device extends toward a water surface in the water tank.

9. The net structure manufacturing apparatus according to claim 8, wherein the ejection direction of water from the water ejection device extends, relative to a vertical direction, toward the net structure located between the conveyors.

10. The net structure manufacturing apparatus according to claim 7, wherein
the water ejection device has an ejection hole from which water is ejected, and
the ejection hole is located below a water surface in the water tank by not less than 0.1 mm and not greater than 400 mm.

11. The net structure manufacturing apparatus according to claim 7, wherein the water ejection device is disposed inside the conveying device.

12. The net structure manufacturing apparatus according to claim 7, wherein the conveying device includes a mesh-pattern belt and a drive roller.

* * * * *